US008099918B2

(12) United States Patent
Marsh et al.

(10) Patent No.: US 8,099,918 B2
(45) Date of Patent: Jan. 24, 2012

(54) SPECIAL AND IMPROVED CONFIGURATIONS FOR UNITIZED POST TENSION BLOCK SYSTEMS FOR MASONRY STRUCTURES

(76) Inventors: Roger F. Marsh, Alexandria, IN (US); Patricia M. Marsh, Alexandria, IN (US)

( * ) Notice: Subject to any disclaimer, the term of this patent is extended or adjusted under 35 U.S.C. 154(b) by 519 days.

(21) Appl. No.: 12/148,501

(22) Filed: Apr. 18, 2008

(65) Prior Publication Data

US 2008/0256894 A1 Oct. 23, 2008

Related U.S. Application Data

(60) Provisional application No. 60/925,224, filed on Apr. 19, 2007.

(51) Int. Cl.
*E04B 2/40* (2006.01)
*E04B 2/06* (2006.01)

(52) U.S. Cl. ..... 52/285.2; 52/253; 52/293.3; 52/431; 52/570; 52/600

(58) Field of Classification Search ..... 52/223.5, 52/223.13, 253, 247, 293.2, 293.3, 431, 570, 52/597, 600, 285.2
See application file for complete search history.

(56) References Cited

U.S. PATENT DOCUMENTS

| | | | | | |
|---|---|---|---|---|---|
| 838,844 | A | | 12/1906 | Clayton | |
| 952,305 | A | | 3/1910 | Buskirk | |
| 962,463 | A | | 6/1910 | Phillips | |
| 1,783,383 | A | * | 12/1930 | Montrief | 52/293.2 |
| 1,892,605 | A | | 12/1932 | Betzler | |
| 2,141,397 | A | * | 12/1938 | Locke | 52/204.2 |
| 2,212,184 | A | * | 8/1940 | Powell | 52/293.2 |
| 2,250,763 | A | | 7/1941 | Hild | |
| 2,929,236 | A | * | 3/1960 | Steward | 52/223.3 |
| 2,963,828 | A | | 12/1960 | Belliveau | |
| 3,236,545 | A | | 2/1966 | Parkes et al. | |
| 3,295,286 | A | | 1/1967 | Schaich | |
| 3,296,758 | A | * | 1/1967 | Knudsen | 52/223.7 |
| 3,382,632 | A | | 5/1968 | Grofcsik | |
| 3,410,044 | A | * | 11/1968 | Moog | 52/309.12 |
| 3,511,000 | A | * | 5/1970 | Keuls | 52/126.4 |
| 3,763,609 | A | | 10/1973 | Probst | |
| 3,785,097 | A | | 1/1974 | Seymour | |
| 4,094,222 | A | | 6/1978 | Lang et al. | |
| 4,569,167 | A | | 2/1986 | Staples | |
| 4,640,071 | A | | 2/1987 | Haener | |
| 4,726,567 | A | | 2/1988 | Greenberg | |
| 4,757,656 | A | * | 7/1988 | Powers, Jr. | 52/204.2 |

(Continued)

OTHER PUBLICATIONS

Definitions of "embed" and "continguous" from Webster's II New College Dictionary, Third Edition, 2005.

(Continued)

*Primary Examiner* — Phi Dieu Tran A
(74) *Attorney, Agent, or Firm* — Faegre & Benson LLP

(57) ABSTRACT

An uniquely improved mortar less masonry structure comprising a plurality of concrete masonry units connected to each other by metal bars and metal threaded fasteners thereby forming a reinforcing skeletal system for the masonry to utilize a post tensioned structure. The unique system has been developed with full recessed channels in the masonry unit, anchor bars that fit into the channels and extend across a plurality of masonry units and bolts that act as the tendon for the post tensioning system. This is an improved, rapidly constructed building system that demountably couples each individual masonry unit by an extended bar and bolt system. This extended bar is more efficient and easier to build with as compared to other traditional masonry structures.

20 Claims, 16 Drawing Sheets

U.S. PATENT DOCUMENTS

| | | | | | |
|---|---|---|---|---|---|
| 4,854,097 | A | * | 8/1989 | Haener | 52/309.11 |
| 5,007,218 | A | | 4/1991 | Bengtson et al. | |
| 5,511,902 | A | | 4/1996 | Center | |
| 5,589,124 | A | * | 12/1996 | Woolford et al. | 264/157 |
| 5,802,792 | A | * | 9/1998 | Fielding et al. | 52/396.09 |
| 5,809,732 | A | | 9/1998 | Farmer, Sr. et al. | |
| 5,924,254 | A | * | 7/1999 | Franklin et al. | 52/439 |
| 5,941,565 | A | | 8/1999 | Clendenin, Jr. | |
| 5,950,319 | A | | 9/1999 | Harris | |
| 6,065,265 | A | * | 5/2000 | Stenekes | 52/607 |
| 6,098,357 | A | | 8/2000 | Franklin et al. | |
| 6,138,426 | A | * | 10/2000 | Mork et al. | 52/562 |
| 6,167,669 | B1 | | 1/2001 | Lanc | |
| 6,178,714 | B1 | | 1/2001 | Carney, Jr. | |
| 6,244,785 | B1 | | 6/2001 | Richter et al. | |
| 6,282,859 | B1 | | 9/2001 | Van Der Heijden | |
| 6,321,498 | B1 | * | 11/2001 | Trovato | 52/426 |
| 6,427,390 | B1 | | 8/2002 | Thies | |
| 6,431,797 | B2 | | 8/2002 | Greenberg | |
| 6,513,296 | B1 | | 2/2003 | Baden | |
| 6,557,316 | B2 | | 5/2003 | Van Der Heijden | |
| 6,632,048 | B2 | | 10/2003 | Greenberg | |
| 6,665,992 | B2 | | 12/2003 | Hew | |
| 6,691,471 | B2 | | 2/2004 | Price | |
| 6,758,020 | B2 | | 7/2004 | Cerrato | |
| 6,904,728 | B2 | | 6/2005 | Stutts | |
| 6,915,614 | B2 | | 7/2005 | Matsufuji | |
| 6,955,015 | B2 | | 10/2005 | Manthei | |
| 7,124,550 | B1 | | 10/2006 | Deming | |
| 7,415,805 | B2 | * | 8/2008 | Nickerson | 52/426 |
| 7,461,490 | B2 | * | 12/2008 | Toledo | 52/605 |
| 2002/0041796 | A1 | | 4/2002 | Greenberg | |
| 2002/0134040 | A1 | | 9/2002 | Hew | |
| 2004/0020145 | A1 | | 2/2004 | Matsufuji | |
| 2004/0144059 | A1 | | 7/2004 | Keshmiri | |
| 2005/0183362 | A1 | | 8/2005 | McCarthy | |
| 2006/0168906 | A1 | | 8/2006 | Tonyan et al. | |
| 2006/0201082 | A1 | | 9/2006 | Hammer et al. | |
| 2007/0017176 | A1 | | 1/2007 | Gray | |
| 2007/0056235 | A1 | | 3/2007 | Kohler | |
| 2007/0107333 | A1 | | 5/2007 | Marsh et al. | |
| 2007/0186502 | A1 | | 8/2007 | Marsh et al. | |
| 2008/0256894 | A1 | | 10/2008 | Marsh et al. | |

OTHER PUBLICATIONS

Examination Report from Australian Patent Office issued in Singapore Patent Application No. 200805986-7, mailed Jul. 21, 2009, 8 pages.

Examination Report from Hungarian Patent Office, issued in Singapore Patent Application No. 2009029671, mailed Apr. 22, 2010, 10 pages.

Examination Report issued in Canadian Application No. 2,627,760, mailed Nov. 4, 2009, 4 pages.

Examination Report issued in Canadian Application No. 2642393, mailed Mar. 15, 2010, 3 pages.

First Office Action from Chinese Patent Office issued in Chinese Patent Application No. 200680042078.3, mailed Dec. 25, 2009, 13 pages.

First Office Action from Chinese Patent Office issued in Chinese Patent Application No. 200680053837.6, mailed Apr. 1, 2010, 15 pages.

International Search Report and Written Opinion issued in PCT/US06/17364, mailed Aug. 7, 2007, 10 pages.

International Search Report and Written Opinion issued in PCT/US06/17523, mailed Sep. 18, 2007, 10 pages.

International Search Report and Written Opinion issued in PCT/US07/82488, mailed Sep. 9, 2008, 13 pages.

International Search Report and Written Opinion issued in PCT/US08/60913, mailed Aug. 21, 2008, 11 pages.

Second Office Action from Chinese Patent Office issued in Chinese Patent Application No. 200680042078.3, mailed Dec. 21, 2010, 5 pages.

Second Office Action from Chinese Patent Office issued in Chinese Patent Application No. 200680053837.6, mailed Dec. 21, 2010, 7 pages.

Written Opinion from Danish Patent Office issued in Singapore Patent Application No. 200803325, mailed Apr. 22, 2009, 9 pages.

* cited by examiner

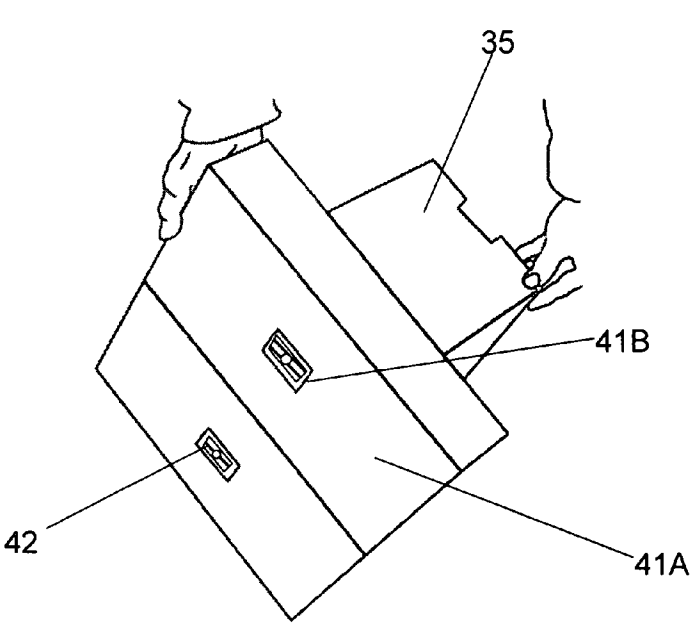
Fig. 4 B
Fig. 4
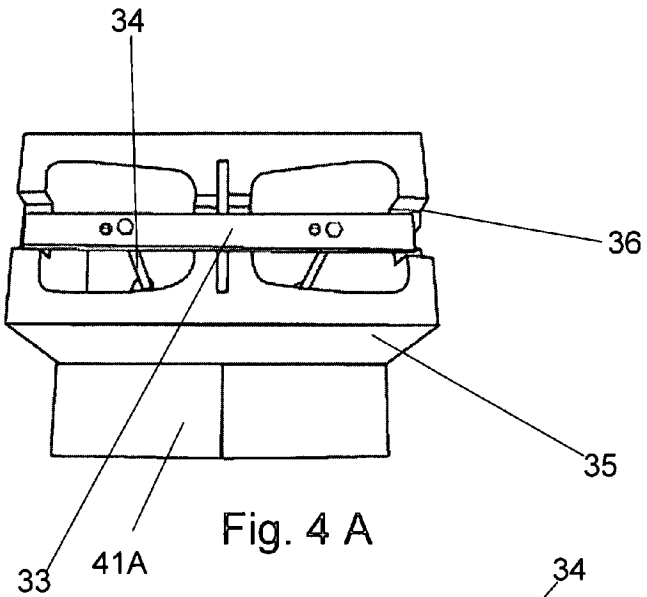
Fig. 4 A
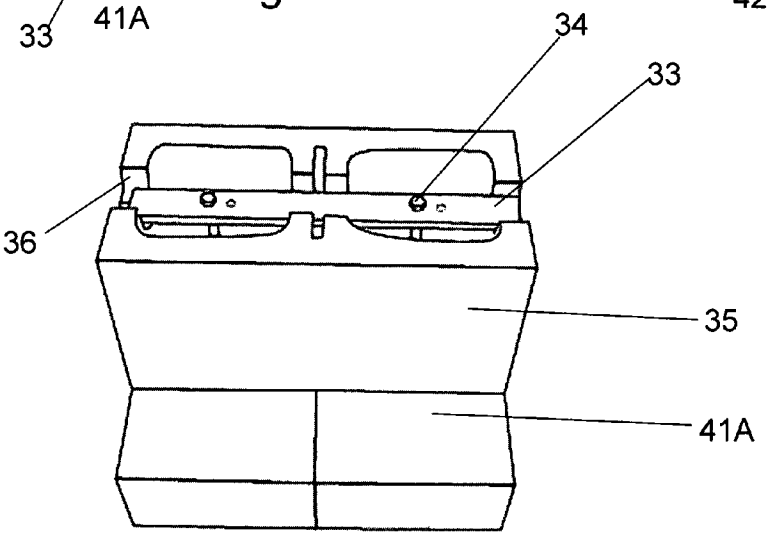
Fig. 4 C

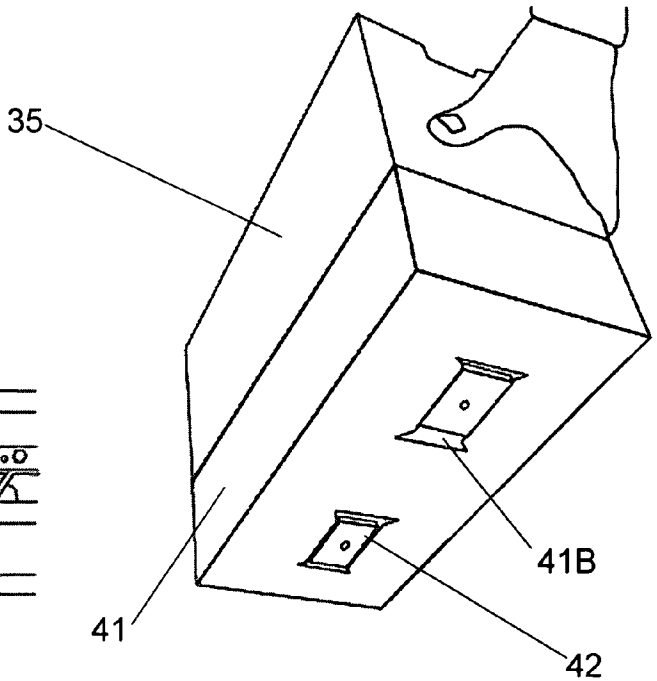
Fig. 5 C
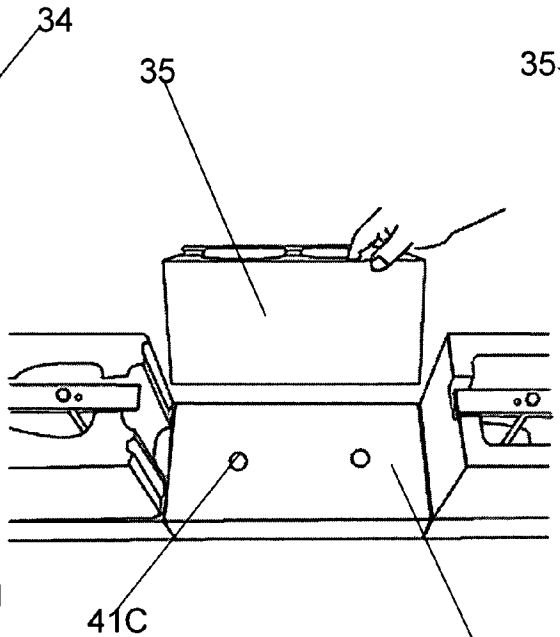
Fig. 5 B
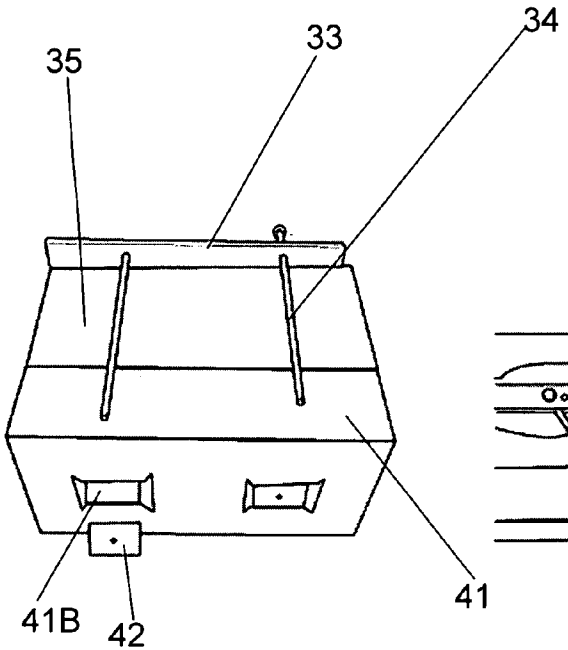
Fig. 5 A
Fig. 5

33A
41
41A
35

35
41B
41

33
34
35
41
41B 33A
35
41
41A

31

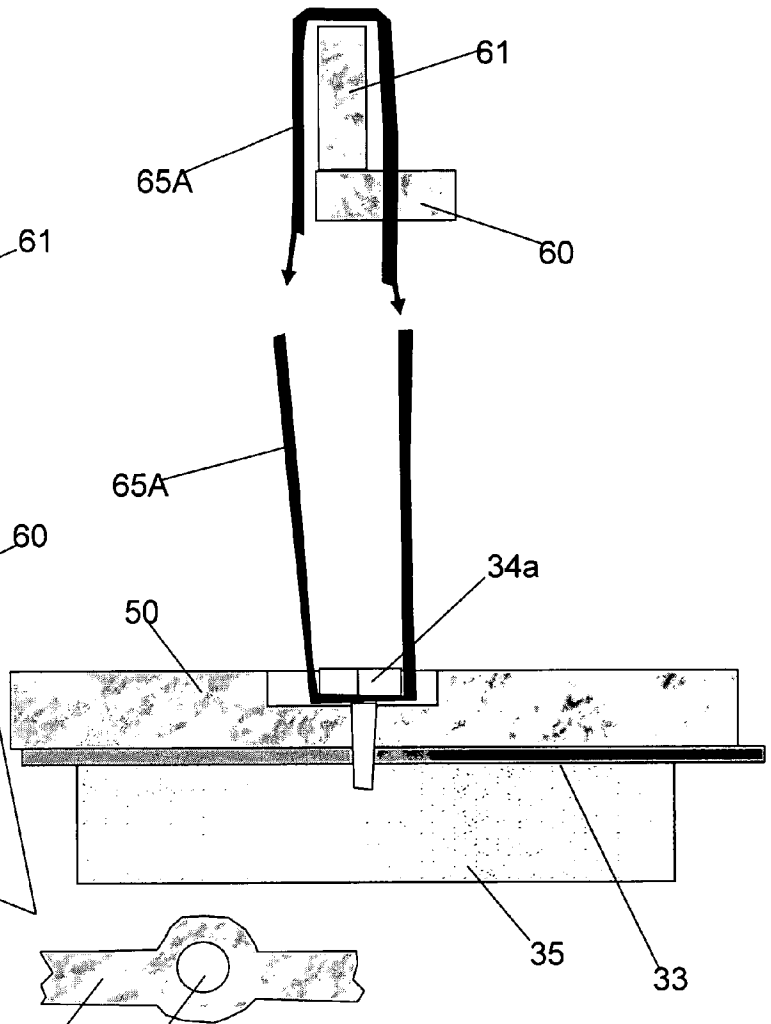
Fig. 9 B
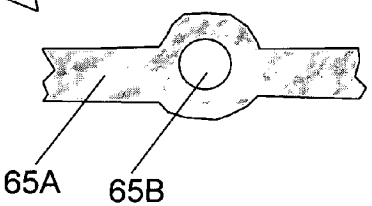
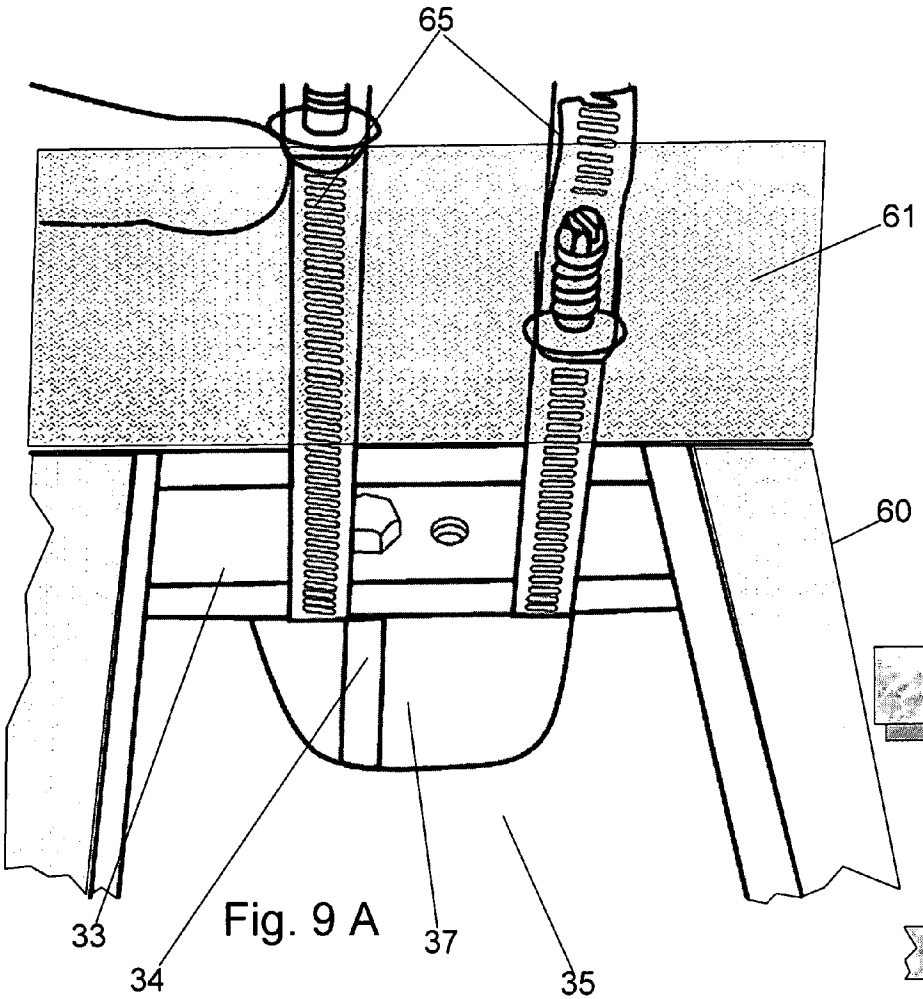
Fig. 9 A
Fig. 9

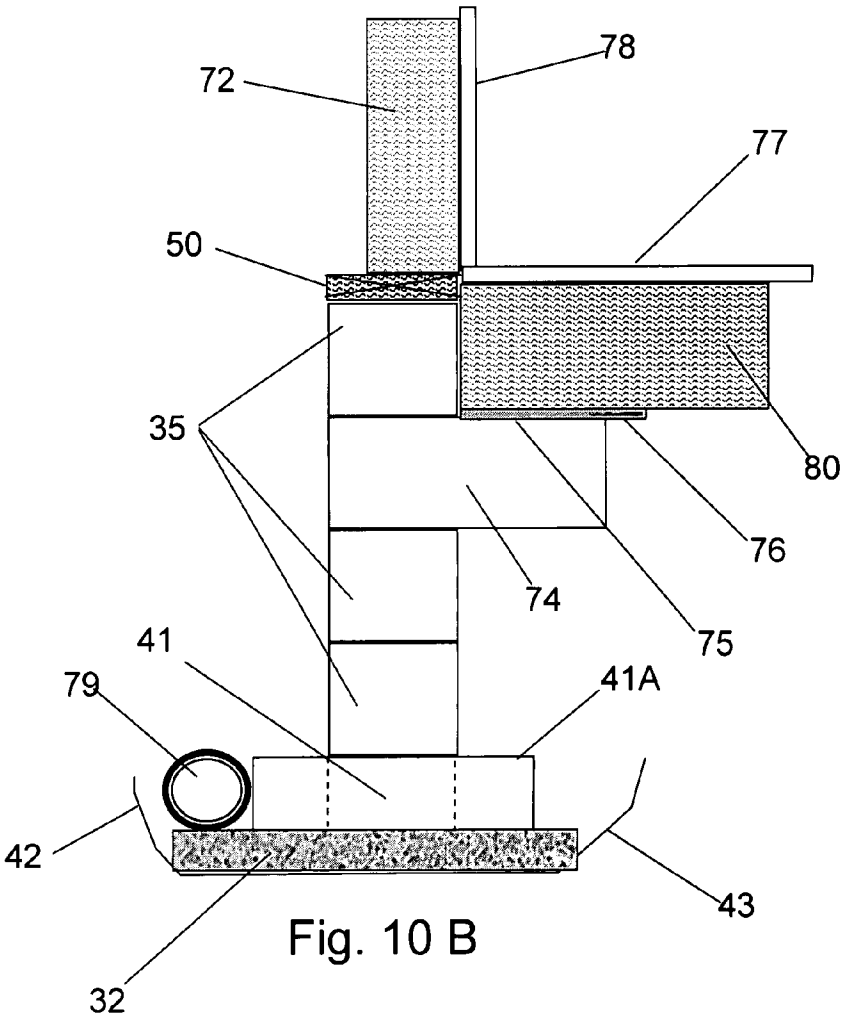
Fig. 10 B
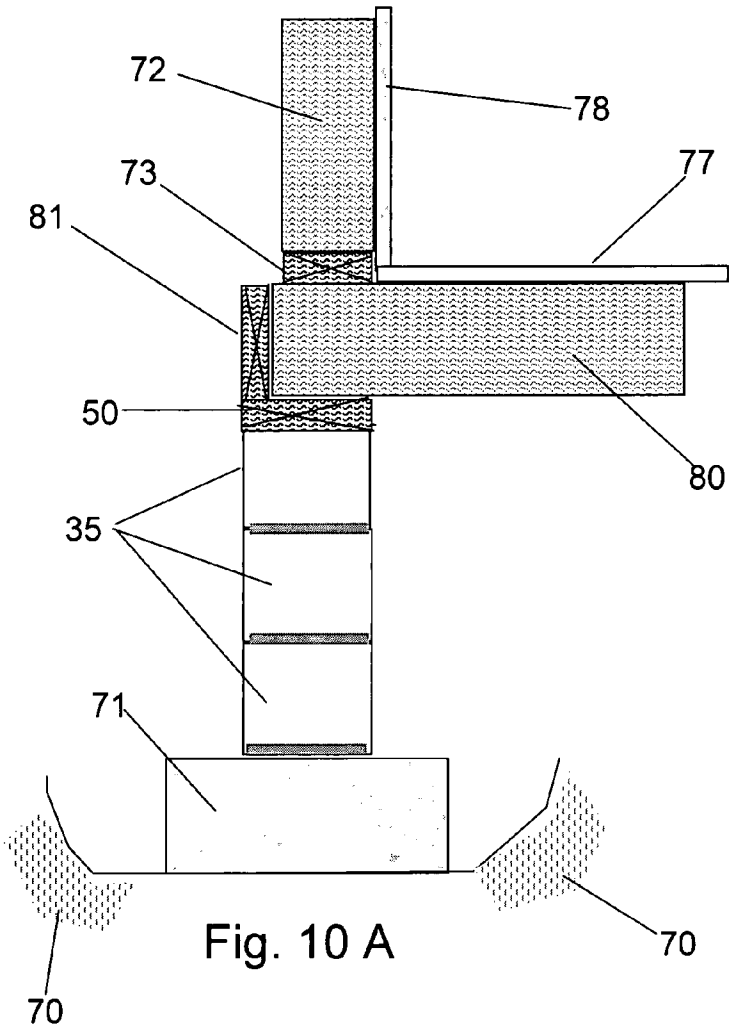
Fig. 10 A
Fig. 10

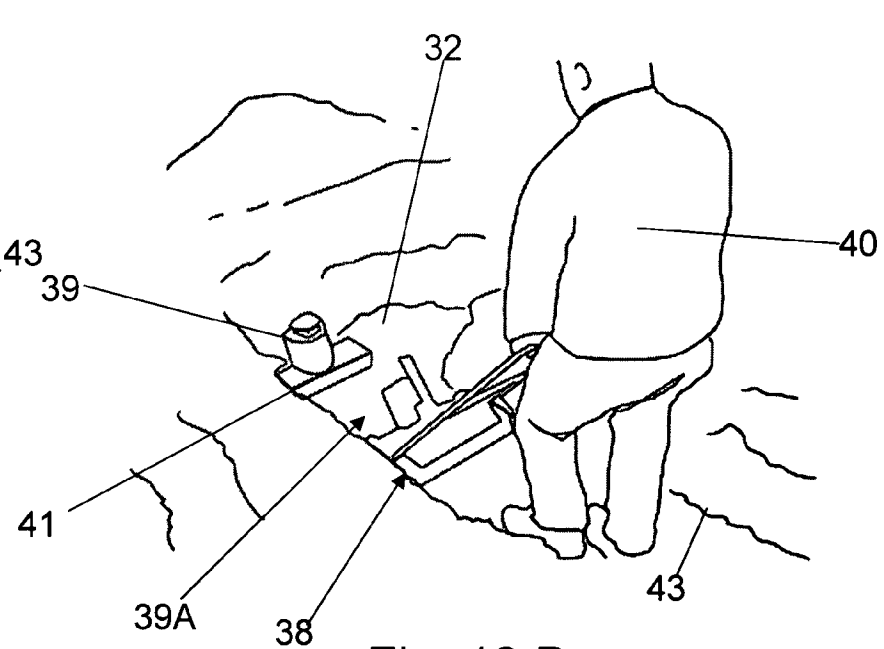
Fig. 12 B
Fig. 12
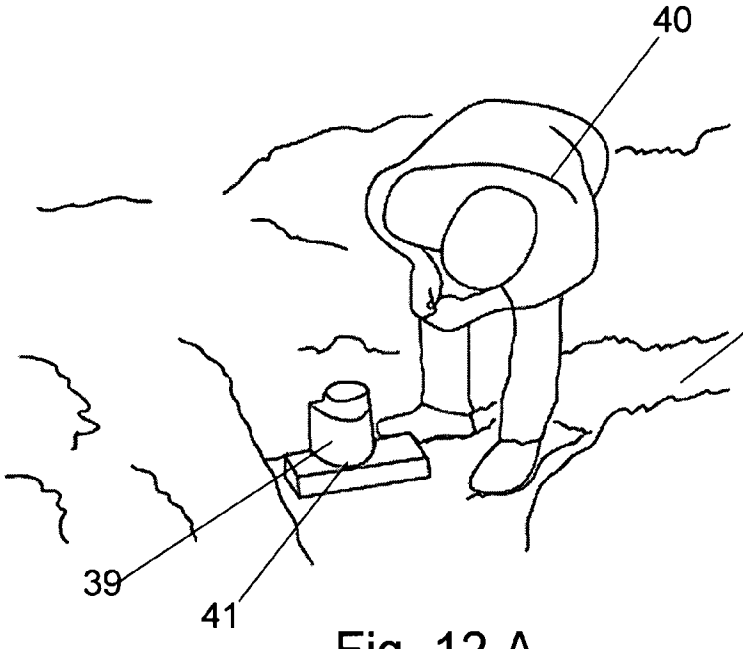
Fig. 12 A

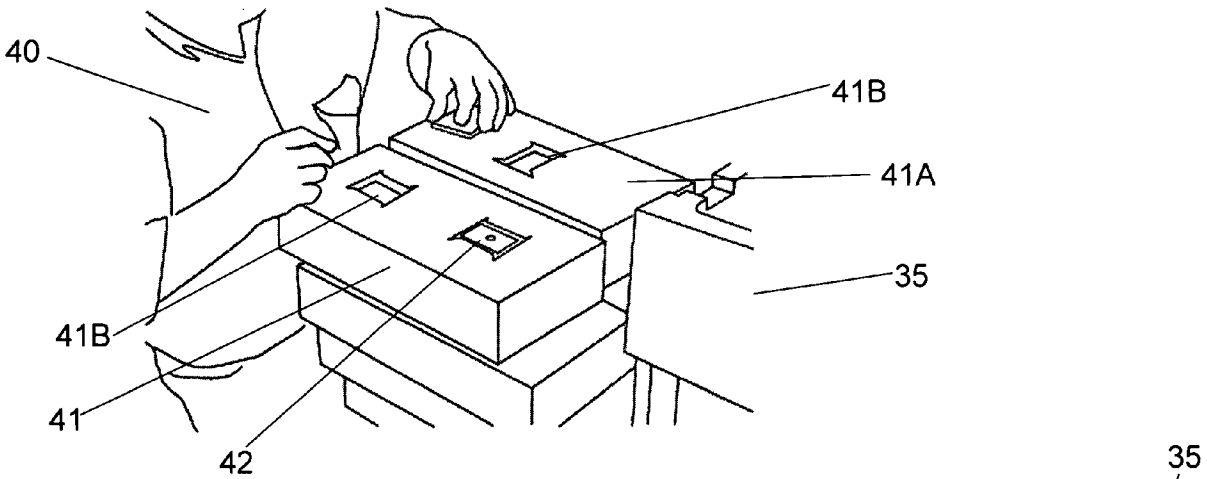
Fig. 13 A
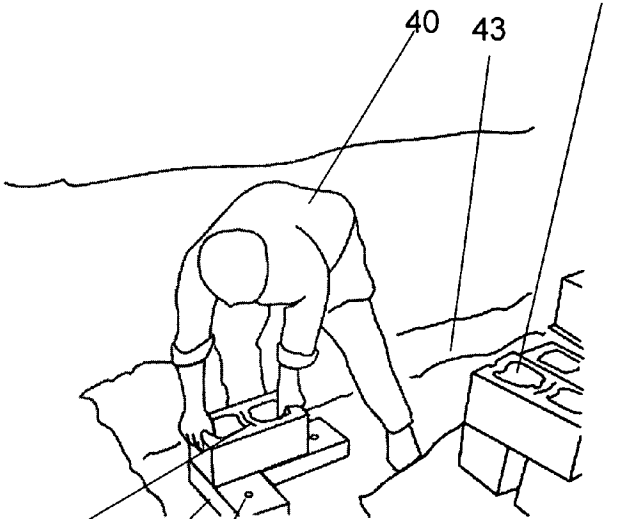
Fig. 13 C
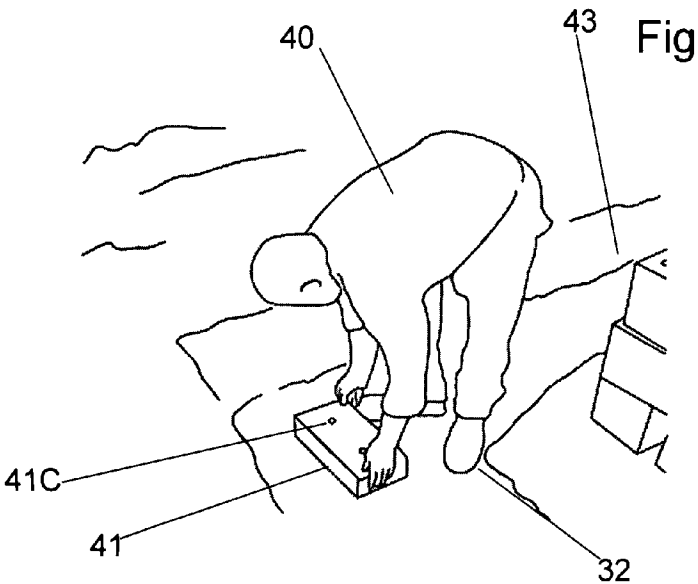
Fig. 13 B
Fig. 13

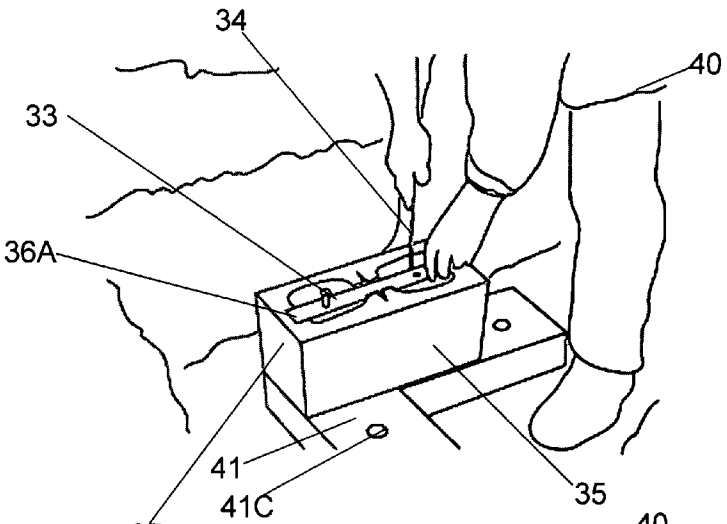
Fig. 14 B
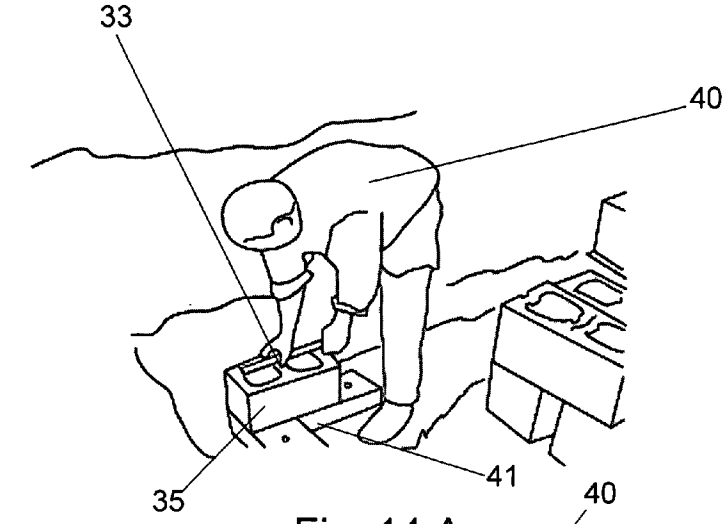
Fig. 14 A
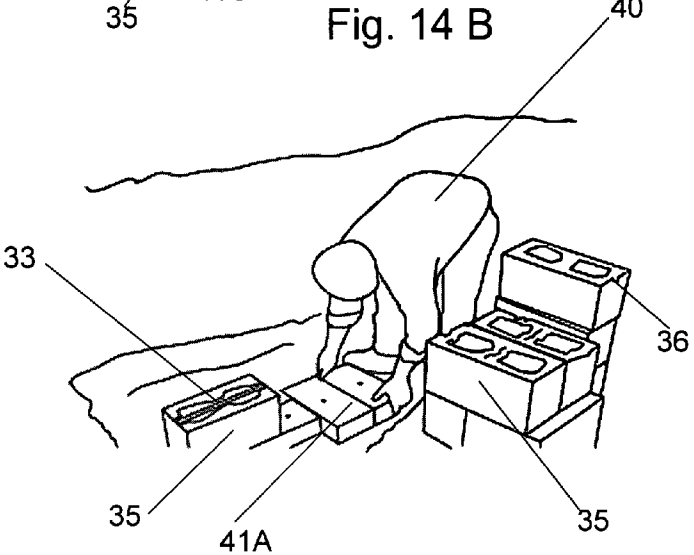
Fig. 14 D
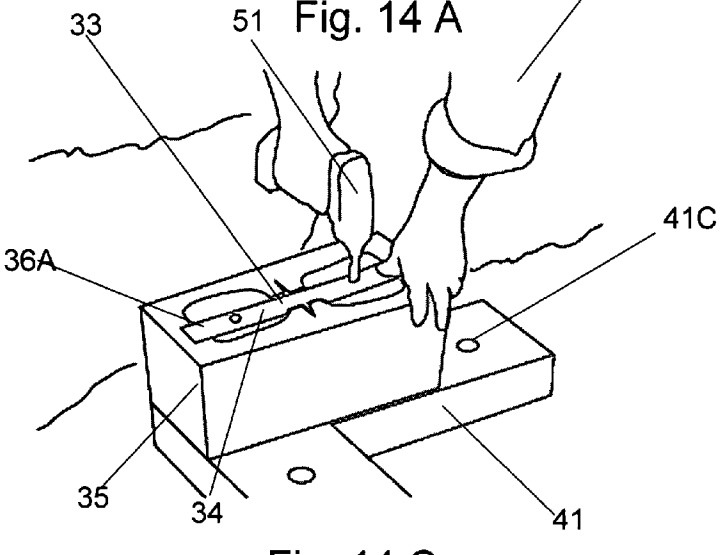
Fig. 14 C
Fig. 14

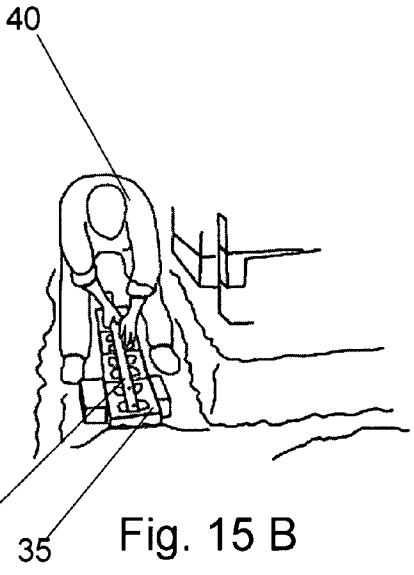
Fig. 15 B
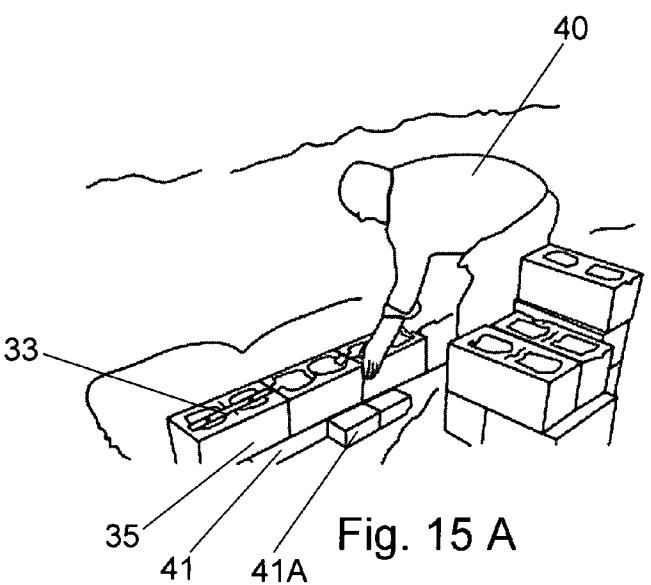
Fig. 15 A
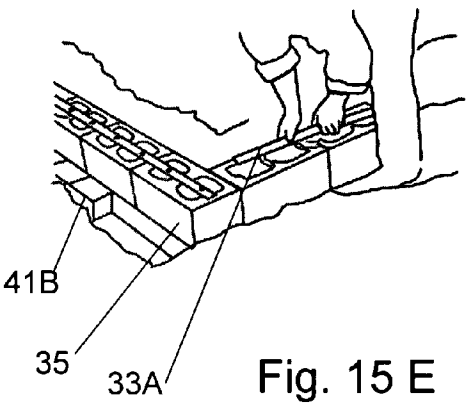
Fig. 15 E
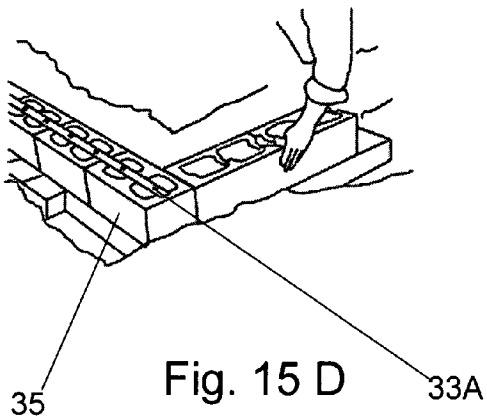
Fig. 15 D
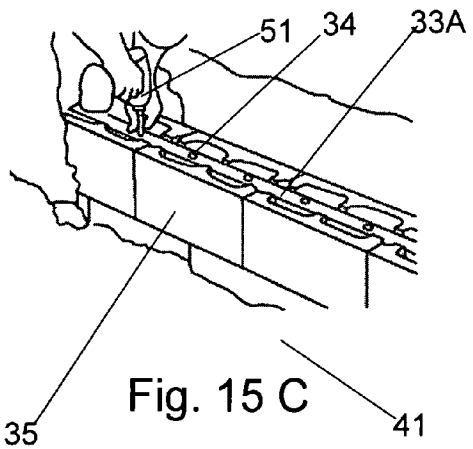
Fig. 15 C
Fig. 15

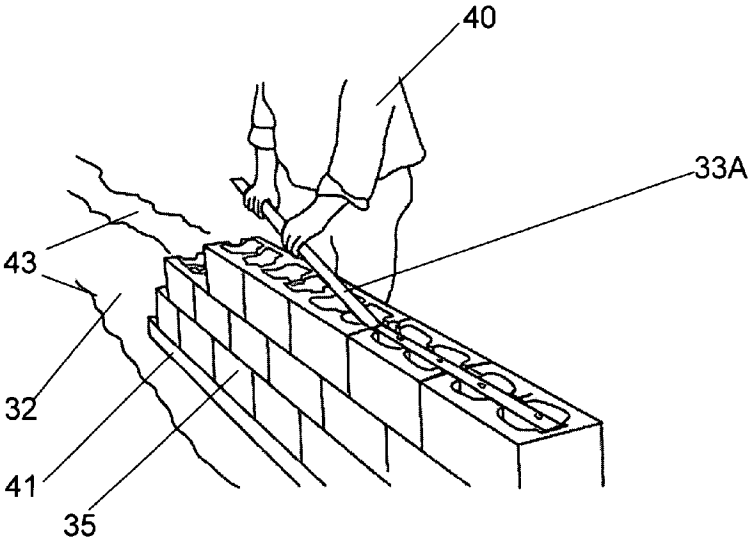
Fig. 16 A
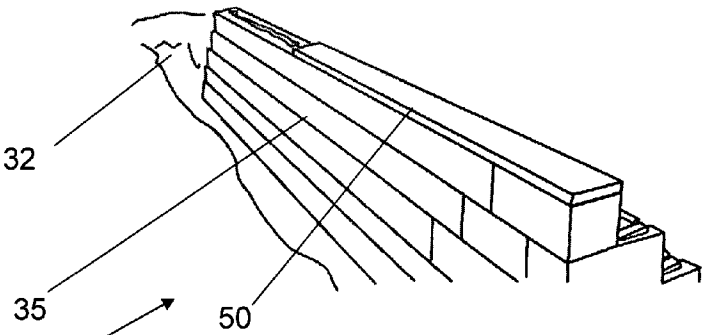
Fig. 16 B
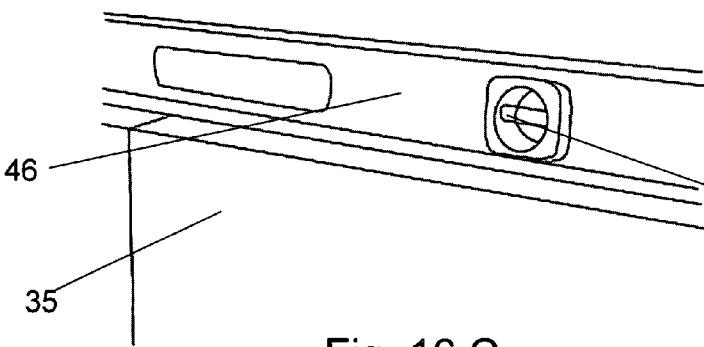
Fig. 16 C
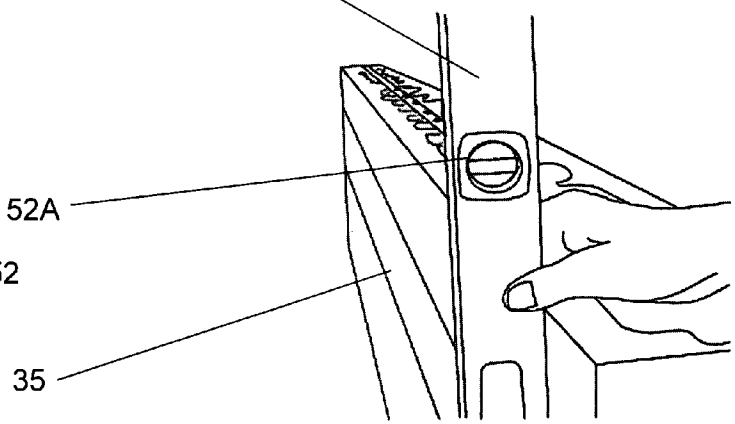
Fig. 16 D
Fig. 16

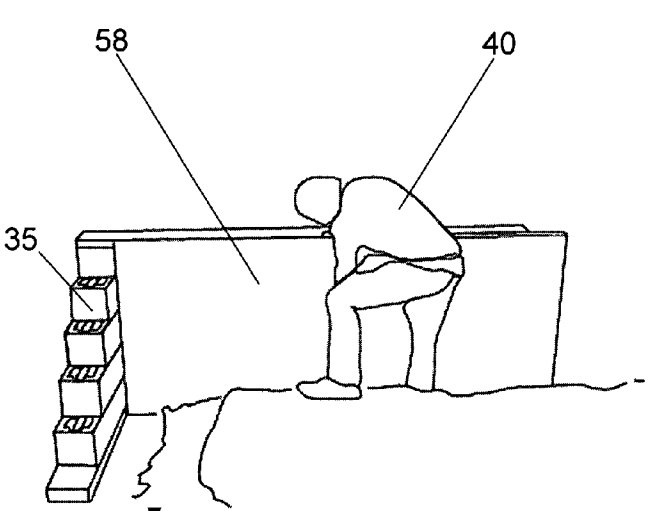
Fig. 17 A
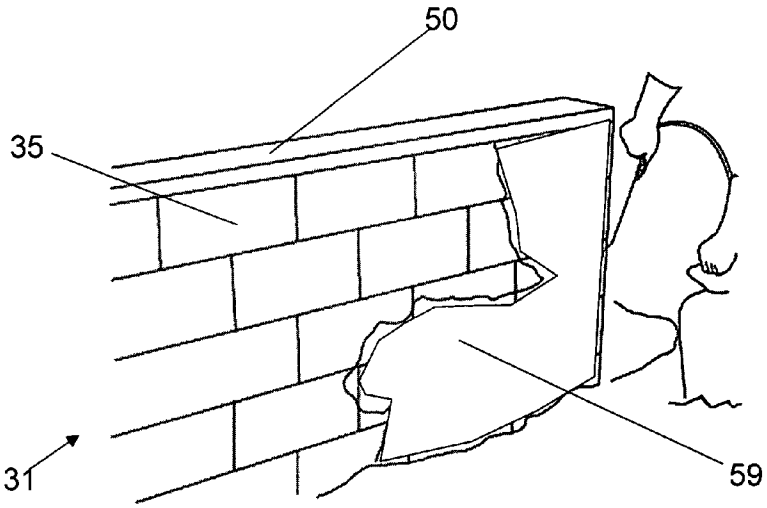
Fig. 17 B
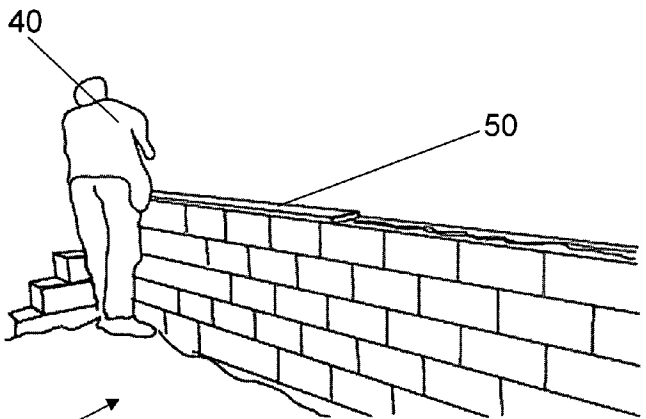
Fig. 17 C
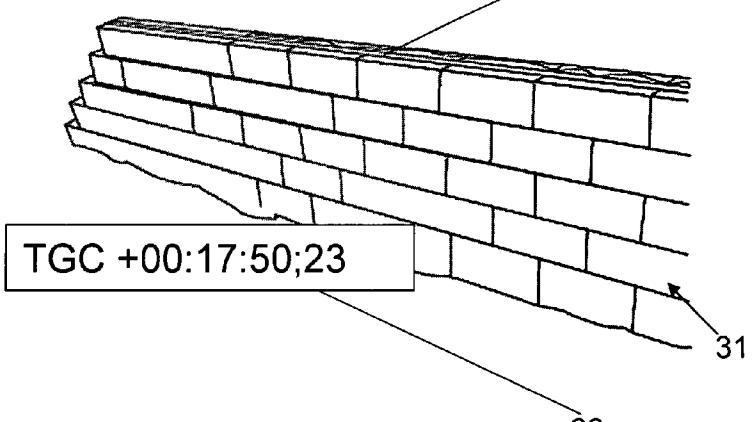
Fig. 17 D
Fig. 17

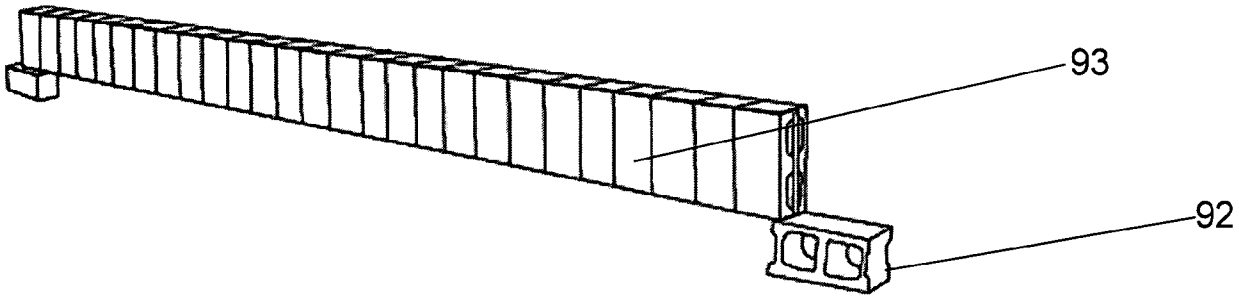
Fig. 18 A
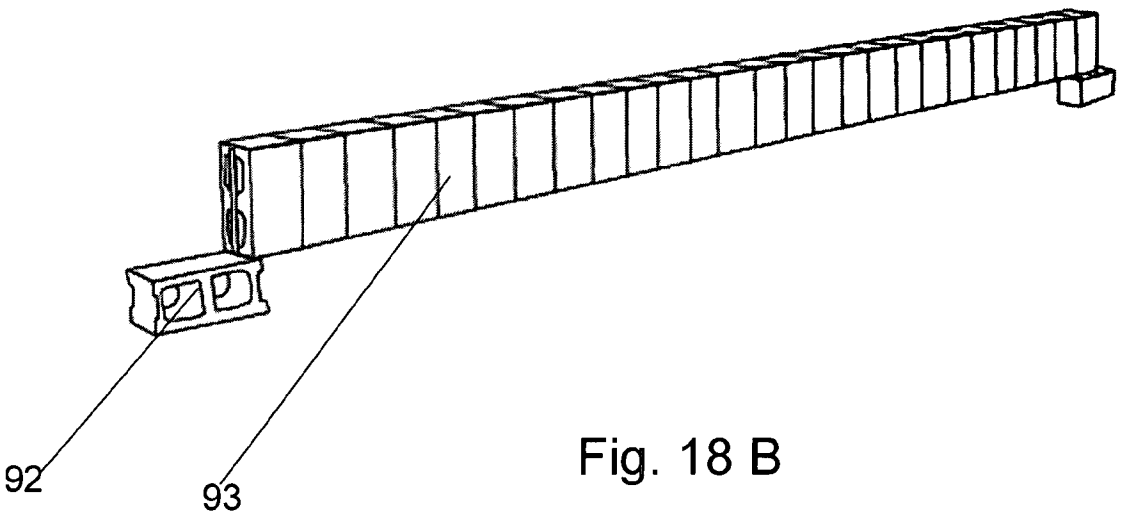
Fig. 18 B
Fig. 18

SPECIAL AND IMPROVED CONFIGURATIONS FOR UNITIZED POST TENSION BLOCK SYSTEMS FOR MASONRY STRUCTURES

CROSS-REFERENCE TO RELATED APPLICATIONS

This invention relates to SPECIAL AND IMPROVED CONFIGURATIONS FOR UNITIZED POST TENSION BLOCK SYSTEM FOR MASONRY STRUCTURES. This application claims the benefit of Provisional Patent Application Ser. No. 60/925,224 filed Apr. 19, 2007 by Roger Marsh et al, and entitled "SPECIAL AND IMPROVED CONFIGURATIONS FOR UNITIZED POST TENSION BLOCK SYSTEM FOR MASONRY STRUCTURES".

FIELD OF INVENTION

This invention relates to a unitized masonry structure, particularly structures with post tensioned reinforcement. The present invention relates generally to all types of general construction where a common mortar and hollow block or brick combination is utilized and relates to other construction means for structures as well. The new concept is called a SPECIAL AND IMPROVED CONFIGURATIONS FOR UNITIZED POST TENSION BLOCK SYSTEMS FOR MASONRY STRUCTURES.

FEDERALLY SPONSORED RESEARCH

None.

SEQUENCE LISTING OR PROGRAM

None.

BACKGROUND

Field of Invention

The new unitized masonry structure described in this specification is an improvement to a construction system that is designed to easily and quickly install in any location without the need for mortar, water, or power. In the United States alone there are over 4000 block manufacturing companies. Traditionally, building blocks and bricks are attached to each other by either of two methods. The first is by gravity, which includes stacking, arches, and flying buttresses. The second is by mortar and mortar equivalent methods, such as various types of mortar, epoxy, or blocks having their cores filled with concrete, with or without reinforcing steel bars (rebars). This attachment usually includes mortar with reinforcing wire in the joints and also includes attachment between masonry units with concrete and rebars in such shapes as bond beam blocks and pier blocks.

When reinforcement means have been used with block, it is typically accomplished with either long rebars or long steel rods or stranded cables placed in the cavities called ducts. The usual reinforcement is without any tensioning of the steel reinforcement, either pre-tensioning or post tensioning. Pre and post tensioning, as one well skilled in the art of construction engineering and techniques knows, increases the overall strength of the concrete unit. Until recently, post tensioning has only been used with a complete stack of block in conjunction with the placement of mortar between each layer. Up to now, most specialty block systems with rods and plates have required very complex design and high levels of skill by construction designers and engineers.

In the latter months of 2005, a newer technique of a bolt, block and bar system—called Bolt-A-Blok—introduced a basic unitized post tensioning where a loose bar is utilized as an anchor across the hollow cavity (or duct) of a concrete masonry unit (CMU) or block. The bar (anchor) has apertures with and without threads which are then individually connected by a through bolt which is essentially the tendon. The bolt (tendon) and bar (anchor) network required some care in the placement of the bar to assure uniformity of the reinforcement web of the tendons and anchors. The then improved method and system described in the system is called a UNITIZED POST TENSION BLOCK SYSTEM FOR MASONRY STRUCTURES has been devised that essentially "locates" the bars uniformly in a recessed cavity or in a pocket of the concrete masonry unit (CMU). These new configurations eliminate any gap between the adjacent CMUs. No filling or caulking of the space is required. Various other embodiments and improvements are described which greatly enhance the post tensioning system first introduced under the Bolt-A-Blok system established as prior art. The latest configuration is a further unique improvement known as a SPECIAL AND IMPROVED CONFIGURATIONS FOR UNITIZED POST TENSION BLOCK SYSTEM FOR MASONRY STRUCTURES. This improvement locates the bars more quickly and is a configuration that permits block or CMU manufacturing to be accomplished in a much more efficient manner.

A. INTRODUCTION OF THE PROBLEMS ADDRESSED

The original Bolt-A-Blok systems addressed methods and systems to improve the masonry systems. This new configuration has addressed the need to rapidly build the walls with multiple bars and with universal hole patterns for bolts not clearly anticipated in the earlier applications. This method is accomplished by longer, multi block bars and universal through holes and tapped holes for placement of the bolt/tendons.

The new system called Bolt-A-Blok facilitated a clear improvement to traditional construction systems and their limitations. The Bolt-A-Blok system does not require special skills to construct; does not need water and power; does not require elaborate bracing; provides immediate occupancy or use; needs no curing time; and, is re-useable if desired since it is not destroyed when disassembled and moved. Bolt-A-Blok system was an improvement to decrease the time to build or rebuild areas with minimal skilled labor. The Bolt-A-Blok system provides a far superior and more consistent strength structure than the traditional mortar constructed structure.

While the Bolt-A-Blok and UNITIZED POST TENSION BLOCK SYSTEM FOR MASONRY STRUCTURES systems addressed many of the common requirements and limitations to traditional mortar and block construction methods, these systems still have some room for improvement. These improvements are addressed by the SPECIAL AND IMPROVED CONFIGURATIONS FOR UNITIZED POST TENSION BLOCK SYSTEM FOR MASONRY STRUCTURES described below.

The improved SPECIAL AND IMPROVED CONFIGURATIONS FOR UNITIZED POST TENSION BLOCK SYSTEM FOR MASONRY STRUCTURES enables block manufacturers to use existing molds and add simple inserts and plates to produce the Unitized Post Tension configuration anticipated with the SPECIAL AND IMPROVED CONFIGURATIONS FOR UNITIZED POST TENSION BLOCK SYSTEM FOR MASONRY STRUCTURES.

Important to note is that none of the prior art teaches all the features and capabilities of the SPECIAL AND IMPROVED CONFIGURATIONS FOR UNITIZED POST TENSION BLOCK SYSTEM FOR MASONRY STRUCTURES.

B. PRIOR ART

Historically, few patented devices have attempted to address the problem as stated. The building industry has made little progress for a unitized, post tension system. Even so, blocks have required very special and often complex configurations to even handle rods and plates and then the have taught only limit rods in special blocks. One such device is described in U.S. Pat. No. 5,511,902 (1996) issued to Center which teaches an Instant levy block system. This is a complex, specially made block for constructing a levy, comprising a plurality of blocks, a plurality of connecting pegs, and a plurality of stakes. Each part is uniquely designed and made whereas the improved SPECIAL AND IMPROVED CONFIGURATIONS FOR UNITIZED POST TENSION BLOCK SYSTEM FOR MASONRY STRUCTURES as described here utilizes a uniform, readily available block design for a concrete masonry unit (CMU).

Another block device is described in A U.S. Pat. No. 5,809,732 which was issued to Farmer, Sr. et al (1998) which teaches a masonry block with an embedded plate. The concrete masonry block has an external plate or plates that are anchored through the concrete masonry block. The external plates are cast into the concrete masonry block in the mold during casting. These plates and metal pieces are not taught as being part of a post tensioning system now shown cast within the hollow cavities as addressed by the improved SPECIAL AND IMPROVED CONFIGURATIONS FOR UNITIZED POST TENSION BLOCK SYSTEM FOR MASONRY STRUCTURES.

Another device for construction is taught by U.S. Pat. No. 6,098,357 issued to Franklin et al. (2000). This art discloses a modular pre-cast construction block system with a wall subsystem and a foundation subsystem. The wall subsystem has a number of wall units having cavities and pre-stressed tension cables are cast therein the cavity. This teaches precast walls and pass through cable which are specially made, require water, and are not readily re-useable like the improved SPECIAL AND IMPROVED CONFIGURATIONS FOR UNITIZED POST TENSION BLOCK SYSTEM FOR MASONRY STRUCTURES. Also, the tensioning system is not unitized or placed throughout the entire structure.

A somewhat re-useable system is taught in the U.S. Pat. No. 6,178,714 issued to Carney, Jr. (2001). The long rods go through apertures in the specially cast block and the precast structures. No description of pre or post tensioning is taught or claimed. The configuration of special length rods, special blocks, special plates and a complex system that requires powered equipment to construct is unlike the improved configuration of the SPECIAL AND IMPROVED CONFIGURATIONS FOR UNITIZED POST TENSION BLOCK SYSTEM FOR MASONRY STRUCTURES A Mortar less wall structure is taught in U.S. Pat. No. 6,691,471 issued to Price (2004). Here a wall structure comprising of columns of preformed, lightweight, stacked blocks, with the columns of blocks connected to each other by elongated, vertically oriented, support beams. Preferably, the wall structure is operatively connected to a structure by one or more brackets. The beams and blocks are special configuration, not readily available and with limited uses. These are complex and do not anticipate the improved device herein as the SPECIAL AND IMPROVED CONFIGURATIONS FOR UNITIZED POST TENSION BLOCK SYSTEM FOR MASONRY STRUCTURES.

A pre-cast, modular spar system having a cylindrical open-ended spar of relatively uniform cross section is taught in a U.S. Pat. No. 6,244,785 issued to Richter, et al (2001). The spar sections are formed by joining arcuate segments and stacking the sections. No design is shown that anticipates this SPECIAL AND IMPROVED CONFIGURATIONS FOR UNITIZED POST TENSION BLOCK SYSTEM FOR MASONRY STRUCTURES.

An interlocking, mortar less system is accomplished by some other devices. However, none of them are found to show a structural unitized post tensioning system as described for the SPECIAL AND IMPROVED CONFIGURATIONS FOR UNITIZED POST TENSION BLOCK SYSTEM FOR MASONRY STRUCTURES in the materials below. An example of one such interlocking device is taught by U.S. Pat. No. 4,640,071 issued to Haener (1987). This teaches a block of concrete or the like for use in constructing a mortar less wall. The device provided includes a spaced parallel pair of upright sidewalls having flat bottoms and tops and bearing integral block interlocking connectors and various configurations on their opposite ends. The sidewalls are integrally connected by means of these configurations. This is not the configuration taught by the SPECIAL AND IMPROVED CONFIGURATIONS FOR UNITIZED POST TENSION BLOCK SYSTEM FOR MASONRY STRUCTURES. Likewise, no post tensioning is taught to increase the structural integrity and strength.

The Bolt-A-Block system was filed Nov. 10, 2005 by Roger Marsh et al with Ser. No. 11/271,703 and published as US 2007-0107333 A1 May 17, 2007. This basic mortar less system taught a masonry structure comprising a plurality of regular masonry blocks and/or bricks connected to each other by a plurality of metal bars and a plurality of standard metal threaded fasteners thereby forming a post tensioned structure. Preferably, the blocks are operatively connected to each other as a structure by simple mechanical tools. Each interconnection results in a unitized post tensioned member that, when interconnected to the adjacent members, forms a comparatively higher strength structure than systems made of mortar and reinforced mortar. The method used to create this structure is a simple, waterless, mortar less interconnection process that is completed by a series of simple individual steps of fastening the blocks and bars into a strong and durable structure. Once connected the structure is strong and durable.

Another Unitized Post Tensioning System was taught by the patent application titled UNITIZED POST TENSION BLOCK SYSTEM FOR MASONRY STRUCTURES Bolt-A-system which was filed Feb. 13, 2006 by Roger Marsh et al (the same inventors) with Ser. No. 11/353,253 and published as 2007-0186502 A1. What the present invention herein entails is a configuration and means to improve the assembly of the Unitized Post Tensioned systems.

Another motarless system is taught by U.S. Pat. No. 3,296,758 by Knudsen (herein after referred to as "Knudsen"). Knudsen appears to discuss a set of superimposed building blocks with vertically spaced flat bars inter-fitted with the blocks and studs inserted through one bar and then threaded into engagement with bars of lower blocks. This Knudsen application fails to anticipate the application by Marsh for several reasons. Knudsen fails to teach or suggest each and every limitation of the claims of Marsh.

None of the prior art found with a rigorous search teaches all the features and capabilities of the SPECIAL AND IMPROVED CONFIGURATIONS FOR UNITIZED POST TENSION BLOCK SYSTEM FOR MASONRY STRUCTURES. As far as known, there are no systems at the present time which fully meet the need for a unitized, post-tensioned masonry block structure as well as the SPECIAL AND IMPROVED CONFIGURATIONS FOR UNITIZED POST TENSION BLOCK SYSTEM FOR MASONRY STRUCTURES. It is believed that this system is made with component parts, is built with simple tools, needs no mortar, provides a much stronger structure than mortar structures, and is ready for immediate use and occupation upon construction.

SUMMARY OF THE INVENTION

A SPECIAL AND IMPROVED CONFIGURATIONS FOR UNITIZED POST TENSION BLOCK SYSTEM FOR MASONRY STRUCTURES has been developed for use in easily constructing various types of masonry structures. The SPECIAL AND IMPROVED CONFIGURATIONS FOR UNITIZED POST TENSION BLOCK SYSTEM FOR MASONRY STRUCTURES is an improvement to the block configuration and building system that demountably couples each individual hollow cored block or brick by use of a bar and bolt system. This coupling results in stronger, faster, and cheaper construction of buildings. While the three main components—a bar, a bolt and a block—are securely connected, the means of attachment is capable of full disassembly if desired. The SPECIAL AND IMPROVED CONFIGURATIONS FOR UNITIZED POST TENSION BLOCK SYSTEM FOR MASONRY STRUCTURES permits less expensive means and configurations to produce the cement block units or CMUs (Cement Masonry Units). The new configuration includes features of a "top only" channel or recess to accept the bar; a series or "long bars" that span a plurality of the CMS; and a special footer block to enable the foundation to placed directly on aggregate rather than a concrete footer.

OBJECTS, ADVANTAGES AND BENEFITS

There are many, many benefits and advantages of the SPECIAL AND IMPROVED CONFIGURATIONS FOR UNITIZED POST TENSION BLOCK SYSTEM FOR MASONRY STRUCTURES. There currently exist no construction systems that use readily availably parts and are so easy to perform. However, by having the unitized post tensioning technology, the structure is a far stronger unit than one built by traditional mortar-using techniques. TABLE A shows a list for the UNITIZED POST TENSION BLOCK SYSTEM of advantages and benefits over the prior art for Bolt-A-Block system. TABLE B shows the list of advantages and benefits of the original Bolt-A-Block over traditional mortar and block systems. The SPECIAL AND IMPROVED CONFIGURATIONS FOR UNITIZED POST TENSION BLOCK SYSTEM FOR MASONRY STRUCTURES encompasses all these advantages in the improved configuration.

TABLE A

ADVANTAGES AND BENEFITS of the UNITIZED POST TENSION BLOCK SYSTEM OVER A BOLT-A-BLOK SYSTEM

| ITEM | DESCRIPTION |
|---|---|
| 1 | elimination of any gap between the CMUs. No filling or caulking of the space is required. |
| 2 | precise placement of the anchor bar |
| 3 | faster build time with the recessed channels or the embedded bars |
| 4 | commercial tracking of the invention with the embedded bars |
| 5 | stronger military/defense use and anti-blast applications |
| 6 | features for easier, faster build with placement aids |
| 7 | features with anti-turn and quick connections with oval plates/washers and threaded tendons |

TABLE B

ADVANTAGES SIMILAR TO BOLT-A-BLOK over Traditional Building Systems

| ITEM | DESCRIPTION |
|---|---|
| 1 | Is Waterless |
| 2 | Requires no wait time to get structural strength |
| 3 | Requires no temporary support while mortar cures and gains strength |
| 4 | Uses simple hand tools |
| 5 | Is Useful with/without footer |
| 6 | Has greater final tensile and compressive strength than mortar construction - is much stronger |
| 7 | Is Environmental friendly - Uses less wood, hence there is less deforestation required to support construction |
| 8 | Has An improved total cost - material and unskilled labor |
| 9 | Permits rapid build. |
| 10 | Can be easily disassemble and components re-used. |
| 11 | Does not require skilled labor |
| 12 | Has Global/worldwide/universal applications |
| 13 | Can be built on soil or standard foundation |
| 14 | Spans greater distances between vertical double blocks |
| 15 | Is easy to learn the build concept and start building with non-skilled workers. With this easy learning curve, it is simple to learn and simple to use. So simple that multiple workers may be in the same area - not "laying" block but assembling a structure |
| 16 | Provides perfect spacing which means more attractive walls. Blocks have perfect alignment and correct placement before tightening |
| 17 | Reduces fire insurance and wind insurance costs |
| 18 | Uses existing modular sizes, worldwide. |
| 19 | Is an all weather construction. All kinds of weather, rain, snow, wind, cold, hot, underwater, even in a diving bell or caisson |

TABLE B-continued

| ADVANTAGES SIMILAR TO BOLT-A-BLOK over Traditional Building Systems | |
|---|---|
| ITEM | DESCRIPTION |
| 20 | Is a Unitized construction. If one stops or anything interrupts the build at any point, one can resume immediately without the former problems of mortar drying out and the other messy problems. |
| 21 | May build a wall by working from either side. Inside or outside. |
| 22 | Works with one or more core block, brick, and other building units |
| 23 | Requires less scaffolding, ladder jacks and walk boards because the walls are immediately at full strength. |
| 24 | Can pour concrete in cores and even add vertical rebar's. |
| 25 | Can pour insulation or spray foam in cores. |
| 26 | Resists flying debris. |
| 27 | Resists Earthquake and Hurricane/tornado. |
| 28 | Is fire resistant. |
| 29 | Is not dependent on mortar strength |
| 30 | Requires no power or gasoline to build |
| 31 | Is useable with other construction techniques - door and window frames, roof and ceiling joists and trusses; metal and asphalt/fiber/rubber roofing; |
| 32 | Is useable with standard plumbing, electrical, communications and lighting packages |
| 33 | Has the ability to construct several block layers at one time - speeds overall construction |
| 34 | Adapts to regular interior (plaster, boars, panel, paint) and exterior wall surfaces (siding, brick, stucco, etc) |
| 35 | Provides perfect plumb and level alignment |
| 36 | Does not require poured foundations |
| 37 | Is a Unit by unit construction |
| 38 | The simple bar and bolt is easily mass produced using existing materials and equipment. |
| 39 | Is possible for the builder to leave out a small portion of the foundation wall so that trucks and backhoes can easily cross into the structure to grade, spread stone, unload concrete or do whatever is necessary. As soon as the heavy inside work is completed, the wall is quickly bolted into place and is ready to go, at full strength. |
| 40 | Provides a mass that is so strong, and the total weight of a UNITIZED POST TENSION BLOCK SYSTEM FOR MASONRY STRUCTURES building is of such significant weight, that below ground freezing may largely only push sideways. |
| 41 | May be combined with a pre-constructed bath and/or kitchen unit. |
| 42 | Is termite and carpenter ant proof. |

For one skilled in the art of construction of structures, especially masonry, concrete, and steel structures, it is readily understood that the features shown in the examples with this system are readily adapted to other types of construction improvements.

DESCRIPTION OF THE DRAWINGS

Figures

The accompanying drawings, which are incorporated in and constitute a part of this specification, illustrate an embodiment of the SPECIAL AND IMPROVED CONFIGURATIONS FOR UNITIZED POST TENSION BLOCK SYSTEM FOR MASONRY STRUCTURES that is preferred. The drawings together with the summary description given above and a detailed description given below serve to explain the principles of the SPECIAL AND IMPROVED CONFIGURATIONS FOR UNITIZED POST TENSION BLOCK SYSTEM FOR MASONRY STRUCTURES. It is understood, however, that the SPECIAL AND IMPROVED CONFIGURATIONS FOR UNITIZED POST TENSION BLOCK SYSTEM FOR MASONRY STRUCTURES is not limited to only the precise arrangements and instrumentalities shown.

FIGS. 4 A through 4 C are sketches of the SPECIAL AND IMPROVED CONFIGURATIONS FOR UNITIZED POST TENSION BLOCK SYSTEM FOR MASONRY STRUCTURES with the cross block footer shown.

FIGS. 5 A to 5 C are sketches of the SPECIAL AND IMPROVED CONFIGURATIONS FOR UNITIZED POST TENSION BLOCK SYSTEM FOR MASONRY STRUCTURES with the linear block footer shown.

FIGS. 9 A and 9 B show sketches and sketches of roof truss clamping means.

FIGS. 10 A and 10 B provide sketches contrasting a typical masonry and mortar footer versus a SPECIAL AND IMPROVED CONFIGURATIONS FOR UNITIZED POST TENSION BLOCK SYSTEM FOR MASONRY STRUCTURES.

FIGS. 12 A and 12 B show are sketches of the method to use and operate the general stone leveling float devices with the SPECIAL AND IMPROVED CONFIGURATIONS FOR UNITIZED POST TENSION BLOCK SYSTEM FOR MASONRY STRUCTURES.

FIGS. 13 A to 13 C are further steps in installing the SPECIAL AND IMPROVED CONFIGURATIONS FOR UNITIZED POST TENSION BLOCK SYSTEM FOR MASONRY STRUCTURES after the level has leveled the stone base.

FIGS. 14 A through 14 D show additional usage and operative details of the SPECIAL AND IMPROVED CONFIGURATIONS FOR UNITIZED POST TENSION BLOCK SYSTEM FOR MASONRY STRUCTURES.

FIGS. 15 A through 15 E show sketches of additional steps in the process of assembly for a SPECIAL AND IMPROVED CONFIGURATIONS FOR UNITIZED POST TENSION BLOCK SYSTEM FOR MASONRY STRUCTURES.

FIGS. 16 A and 16 D show sketches of the leveled stone base resulting in level and plumb wall systems for the SPECIAL AND IMPROVED CONFIGURATIONS FOR UNITIZED POST TENSION BLOCK SYSTEM FOR MASONRY STRUCTURES.

FIG. 17 A through D show finishing steps for the process of assembling and completing the SPECIAL AND IMPROVED CONFIGURATIONS FOR UNITIZED POST TENSION BLOCK SYSTEM FOR MASONRY STRUCTURES.

FIGS. 18 A and 18 B show sketches of beam applications for SPECIAL AND IMPROVED CONFIGURATIONS FOR UNITIZED POST TENSION BLOCK SYSTEM FOR MASONRY STRUCTURES.

DESCRIPTION OF THE DRAWINGS

Reference Numerals

Figure 1:
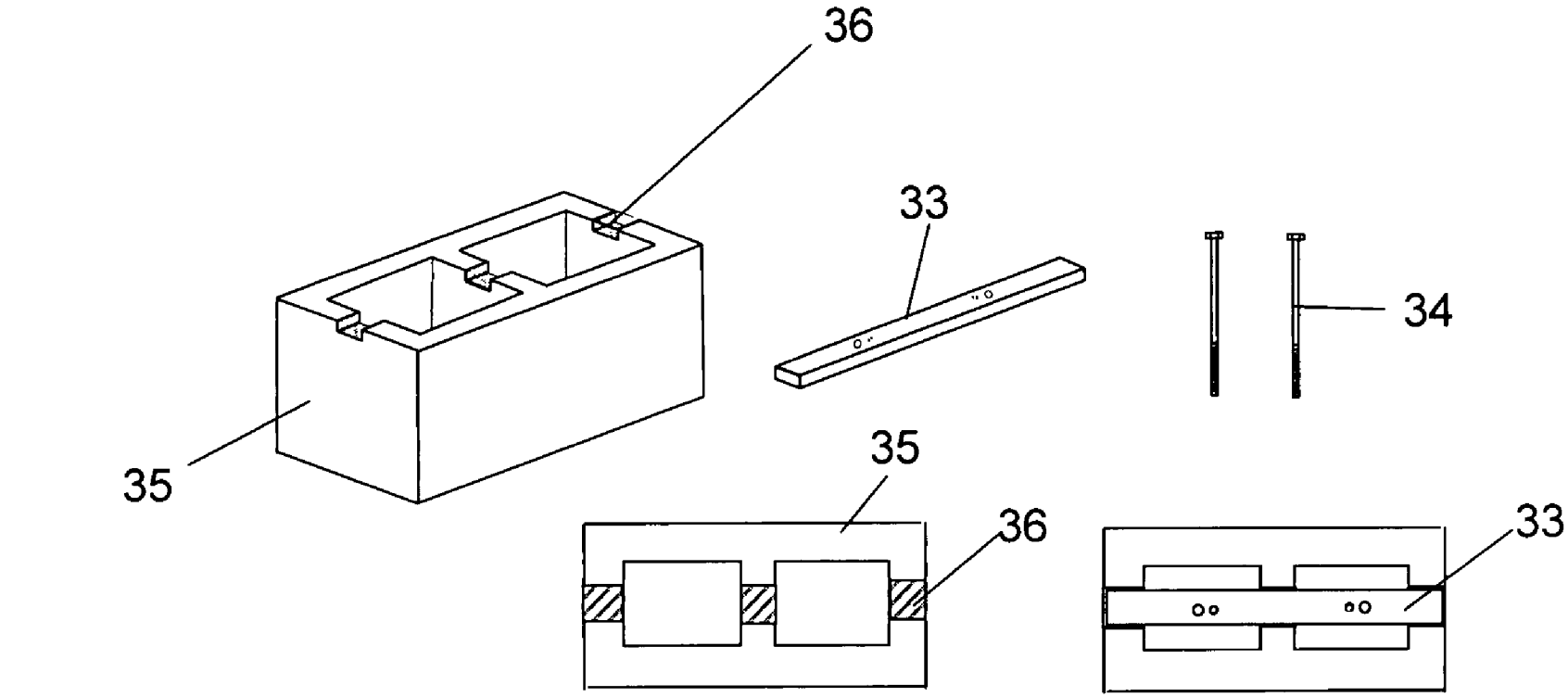
FIG. 1 are sketches of the general SPECIAL AND IMPROVED CONFIGURATIONS FOR UNITIZED POST TENSION BLOCK SYSTEM FOR MASONRY STRUCTURES.

The following list refers to the drawings:

| | |
|---|---|
| 31 | General assembly of the SPECIAL AND IMPROVED CONFIGURATIONS FOR UNITIZED POST TENSION BLOCK SYSTEM FOR MASONRY STRUCTURES - TOP recessed bar positioner channel |
| 32 | Stone or aggregate |
| 33 | Anchor for post tensioning such as a bar with connection features |
| 33A | Relatively longer anchor bar compared to unit bar (33) |
| 33B | Angular base float |
| 34 | Tendon for post tensioning such as a bolt |
| 34A | Short Tendon for connecting to a plate or the like |
| 35 | Concrete masonry unit with recess channels |
| 35A | Split faced block with top recess |
| 36 | Extended recess channels |
| 36A | Extended recess channels with closed surface for end block |
| 37 | Duct or cavity in the block |
| 38 | General stone leveling sled device |
| 39 | Signal generator |
| 39A | Signal receiver unit |
| 40 | Operator/worker/installer |
| 41 | Linear footer block |
| 41A | Cross base footer block |
| 41B | Plate receiver pocket |
| 41C | Block through aperture for bolt |
| 42 | Bolt plate with threaded aperture for bolt |
| 43 | Footer trough |
| 45 | Connector bar |
| 46 | Carpenter's level in horizontal position |
| 46A | Carpenter's level in vertical position |
| 48 | Notch |
| 49 | Notch filler |
| 50 | Wall sill plate |
| 51 | Drive tool |
| 52 | Indicator level |
| 52A | Indicator plumb |
| 58 | Siding and insulation panel (interior or exterior) |
| 59 | Sealant - water based, bituminous or equal |
| 60 | Top plate for truss support |
| 61 | Roof joist/truss system |
| 65 | Means to attach (truss to wall) such as a band clamp |
| 65A | Alternative means to attach (truss to wall) such as a plastic or composite material clamp |
| 66 | Time INDICATION |
| 70 | Earthwork near foundations |
| 71 | Foundation concrete |
| 72 | Wall stud |
| 73 | Base plate |

-continued

| | |
|---|---|
| 74 | Extra wide ledger CMU |
| 75 | Ledge |
| 76 | Shim |
| 77 | Sub flooring |
| 78 | Interior wall surface such as gypsum, sheeting, panel, or the like |
| 79 | Perimeter drain |
| 80 | Floor joist |
| 81 | Band Board |
| 92 | Beam support |
| 93 | Soldier type beam |

DETAILED DESCRIPTION OF PREFERRED EMBODIMENT

The present invention is a construction system called a SPECIAL AND IMPROVED CONFIGURATIONS FOR UNITIZED POST TENSION BLOCK SYSTEM FOR MASONRY STRUCTURES 31.

This post tensioning system is comprised of only a few different types of components—a concrete block or concrete masonry unit 35 (CMU) with extended recessed channels 36 (and others) in which the hollow cavity 37 is the duct, a series of tendons (such as a through bolt) 34, and a plurality of simple anchors (such as a bar) 33 with some additional features. The system is configured with the plurality of adjacent blocks 35 contiguous and touching one another and demountably coupled to each other by means of the tendons 34 and anchors 33. This coupling results in a structure that is formed from a plurality of unitized, post tensioned concrete masonry units (usually called blocks or bricks) that collectively are far stronger than an ordinary block structure built with mortar and standard reinforcing. A person having ordinary skill in the field of construction, especially with reinforced masonry structures, appreciates the various parts that may be used to physically permit this SPECIAL AND IMPROVED CONFIGURATIONS FOR UNITIZED POST TENSION BLOCK SYSTEM FOR MASONRY STRUCTURES 31 to be produced and utilized. The improvement over the existing art is providing a construction system that has many advantages and benefits as stated in the previous section entitled Objects, Advantages, and Benefits. The advantage over the newer Bolt-A-Blok includes precise placement of the anchor bar and faster build time with the extended recessed channels 36.

There is shown in FIGS. 1 through 10, and in FIG. 18 a complete operative embodiment of the UNITIZED POST TENSION BLOCK SYSTEM FOR MASONRY STRUCTURES 31 and alternative embodiments. In the drawings and illustrations, one notes well that drawings and sketches demonstrate the general configuration of this invention. The preferred embodiment of the system is comprised of only a few parts as shown. Various important features of these components are also delineated and are described below in appropriate detail for one skilled in the art to appreciate their importance and functionality to the SPECIAL AND IMPROVED CONFIGURATIONS FOR UNITIZED POST TENSION BLOCK SYSTEMS FOR MASONRY STRUCTURES 31.

The accompanying drawings, which are incorporated in and constitute a part of this specification, illustrate embodiments of the SPECIAL AND IMPROVED CONFIGURATIONS FOR UNITIZED POST TENSION BLOCK SYSTEMS FOR MASONRY STRUCTURES 31 that are preferred. The drawings together with the summary description given above and a detailed description given below serve to explain the principles of the SPECIAL AND IMPROVED CONFIGURATIONS FOR UNITIZED POST TENSION BLOCK SYSTEMS FOR MASONRY STRUCTURES 31. It is understood, however, that the SPECIAL AND IMPROVED CONFIGURATIONS FOR UNITIZED POST TENSION BLOCK SYSTEMS FOR MASONRY STRUCTURES 31 is not limited to only the precise arrangements and instrumentalities shown.

FIG. 1 are sketches of the general SPECIAL AND IMPROVED CONFIGURATIONS FOR UNITIZED POST TENSION BLOCK SYSTEM FOR MASONRY STRUCTURES 31. The concrete masonry unit 35, the extended recess channel 36, the anchor bar 33, the tendon/bolts 34 are shown as an isometric and top views with and without the anchors 33.

Figures 2, 3, 3A, 3B, 3C:
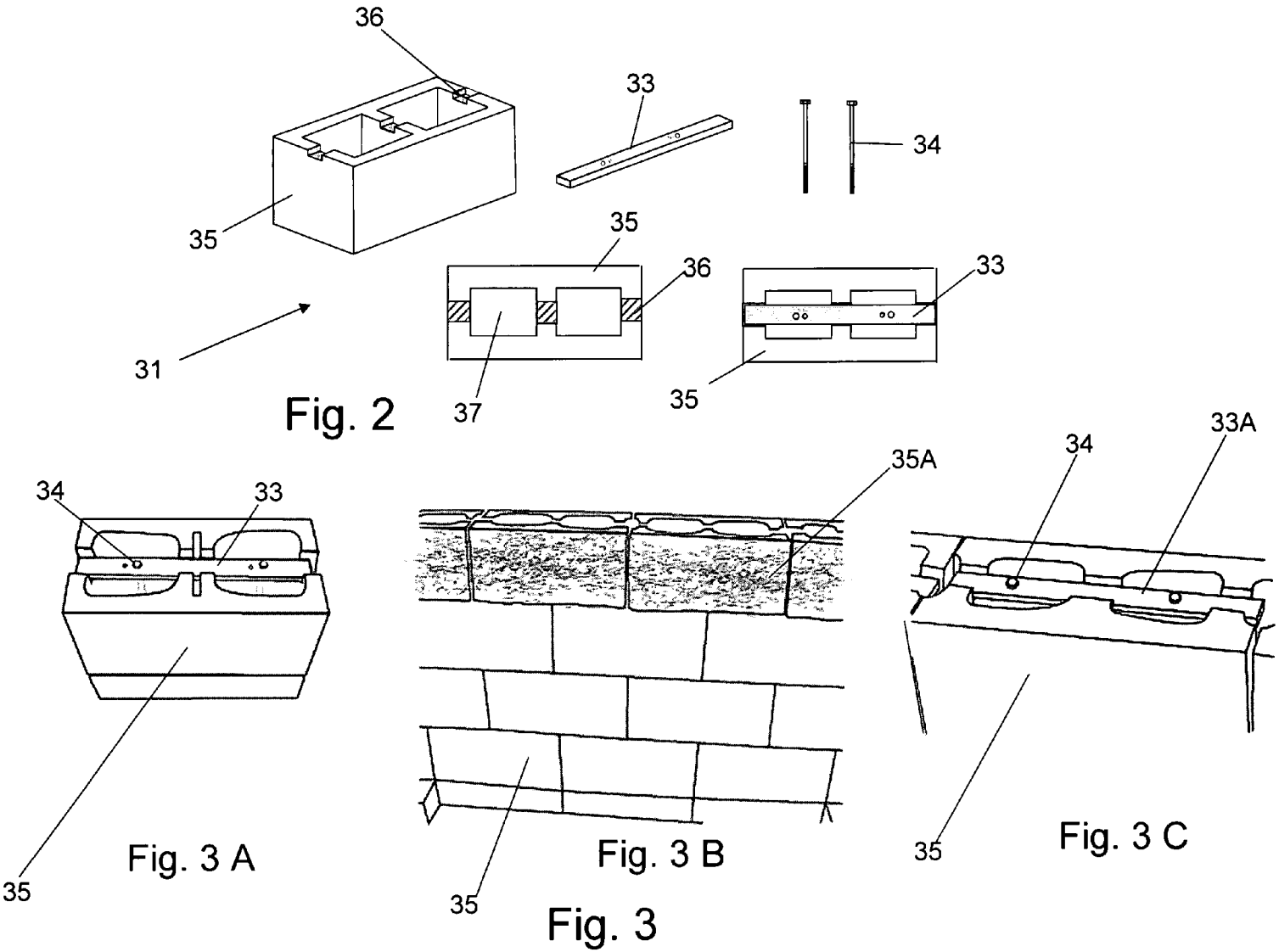
FIG. 2 are sketches of the general SPECIAL AND IMPROVED CONFIGURATIONS FOR UNITIZED POST TENSION BLOCK SYSTEM FOR MASONRY STRUCTURES with components and features noted.
FIG. 3 A through C are sketches of prototype systems and components.

FIG. 2 is a repeat of FIG. 1 shown with the various sketches of in FIG. 3. The sketches are of the general SPECIAL AND IMPROVED CONFIGURATIONS FOR UNITIZED POST TENSION BLOCK SYSTEMS FOR MASONRY STRUCTURES 31 with specific features and components identified. The SPECIAL AND IMPROVED CONFIGURATIONS FOR UNITIZED POST TENSION BLOCK SYSTEMS FOR MASONRY STRUCTURES 31 shown is the preferred embodiment. Here the concrete masonry units 35 with extended pocket recesses 36 are shown. They may be stacked together as a general configuration as shown in FIG. 3. The extended pocket recesses 36 are show in which the bars 33 may be placed. Each CMU block 35 is touching the adjacent block. This is a very distinct improvement to prior art for speed of assembly and for elimination of a gap between the CMUs. The longer bars or anchors 33 span several blocks 35 and permit more efficiency in placement and less labor/time to connect the overall assembly. Obviously, the anchors/bars 33 and the tendons/bolts 34 may be manufactured from may types of materials including, but not limited to metal (such as steel, Corten (steel code ASTM A 242 or equal) or rust inhibiting steel, stainless steel, titanium, brass, aluminum and the like); from composite materials (including plastics and reinforced plastics; reinforced resin based materials, and the like); and from other materials suitable to create tendons and anchors for a post tensioning system. The stack 31 is mounted onto the base means 32 or 71 by placing the CMU 35 directly onto a footer block 41 with a tendon 34 into a receiving plate 42 for the an anchor 34. The bolt/tendons 34 join each anchor/bar 33 individually. The entire stack 31 is mounted on the base means 32 by the base anchor 34.

FIG. 3 A through 3 C are sketches of prototype systems and components. They show the block 35, bar or anchor 33 and bolt or tendon 34. A split face option 35A is shown as well as a relative longer bar 33A.

FIGS. 4 A through 4 C are sketches of the SPECIAL AND IMPROVED CONFIGURATIONS FOR UNITIZED POST TENSION BLOCK SYSTEM FOR MASONRY STRUCTURES 31 with the cross block footer 41A shown. The various components described above include the bolt/tendon 34, the bar/anchor 33 and the concrete masonry unit (CMU) 35. One also notes the extended recess 36 in the CMU 35 to "accept" and contain the bar 33. Equally important is the cross footer 41A, the recess/pocket 41B and the plate 42. The receiving plate 42 is contained in the footer block 41A and permits an anti-turn feature. Therefore the bolt/tendon 34 engages the plate 42 and is permitted to create a tension connection between the anchor/bar 33 and plate 42 with the tendon/bolt 33. The CMU 35 is thereby contained and placed in a post tension between the plate 42 and bar 33 by the engagement and tightening of the bolt/tendon 34. The CMU 35 is thus post tensioned and placed with a stress on the block 35 which creates a certain stress within the structure which increases the overall strength of the assembly.

FIGS. 5 A to 5 C are sketches of the SPECIAL AND IMPROVED CONFIGURATIONS FOR UNITIZED POST TENSION BLOCK SYSTEM FOR MASONRY STRUCTURES 31 with the linear block footer 41 shown. Again, the various components described above include the bolt/tendon 34, the bar/anchor 33 and the concrete masonry unit (CMU) 35. One also previews the extended recess 36 in the CMU 35 to "accept" and contain the bar 33. Equally important is the linear footer block 41, the recess/pocket 41B and the plate 42. The receiving plate 42 is contained in the linear footer block 41 and permits an anti-turn feature. Therefore the bolt/tendon 34 engages the plate 42 and is permitted to create a tension connection between the anchor/bar 33 and plate 42 with the tendon/bolt 33. The CMU 35 is thereby contained and placed in a post tension between the plate 42 and bar 33 by the engagement and tightening of the bolt/tendon 34. The CMU 35 is thus post tensioned and placed with a stress on the block 35 which creates a certain stress within the structure which increases the overall strength of the assembly.

Figures 6, 6A, 6B, 6C, 6D:
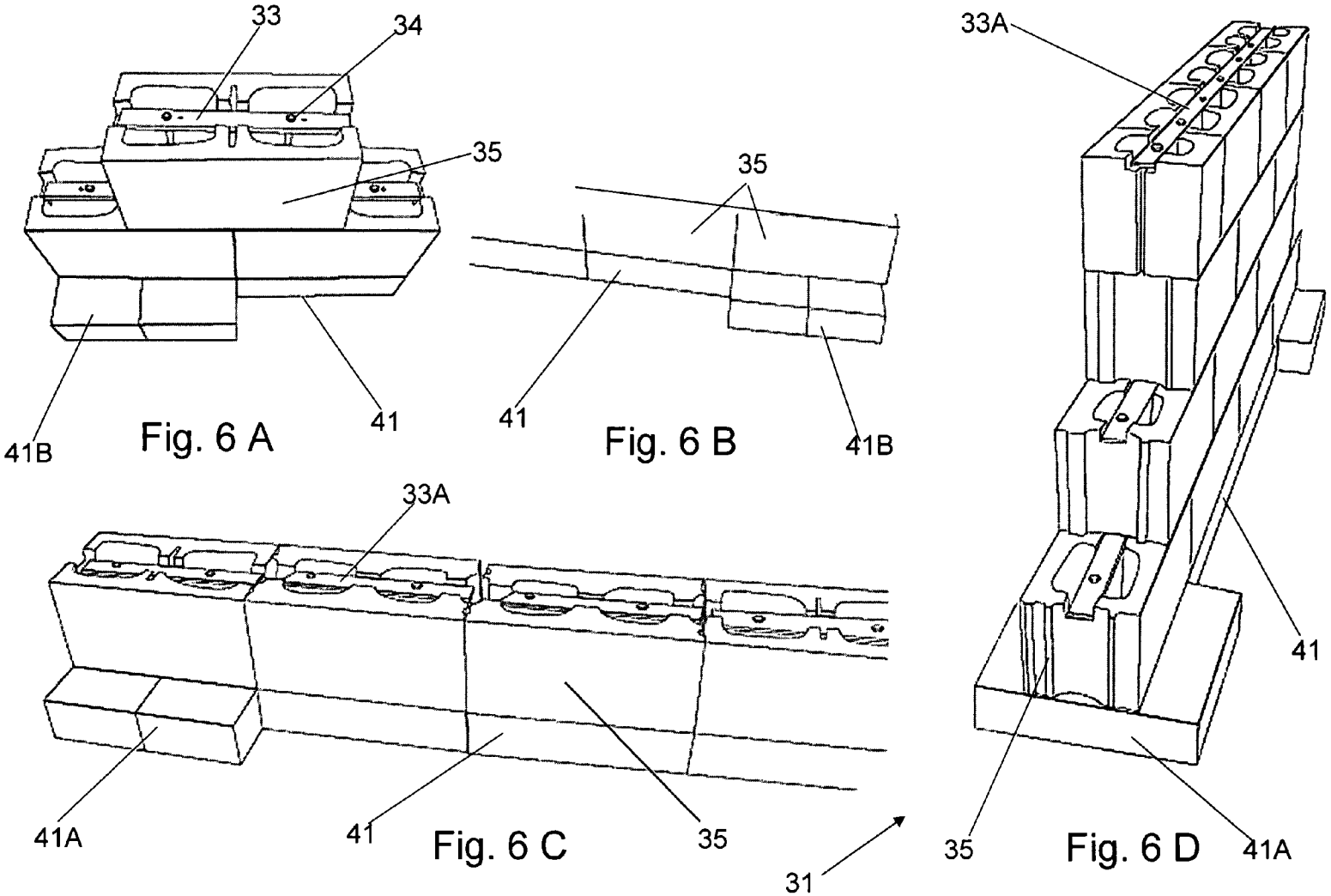
FIGS. 6 A through 6 D show sketches of the cross and linear footer blocks with the SPECIAL AND IMPROVED CONFIGURATIONS FOR UNITIZED POST TENSION BLOCK SYSTEM FOR MASONRY STRUCTURES.

FIGS. 6 A through 6 D show sketches of the cross 41A and linear 41 footer blocks with the SPECIAL AND IMPROVED CONFIGURATIONS FOR UNITIZED POST TENSION BLOCK SYSTEM FOR MASONRY STRUCTURES 31. The blocks 35, bars 33 and bolts 34 are also shown. The two footer types 41 and 41A can be used together as shown in the four (4) views. The cross footers 41A also permits free standing walls and dividers to be assembled and surface mounted. Afterward, if desired they can be dis-assembled and removed.

Figures 7, 7A, 7B, 7C, 8, 8A, 8B, 8C, 8D:
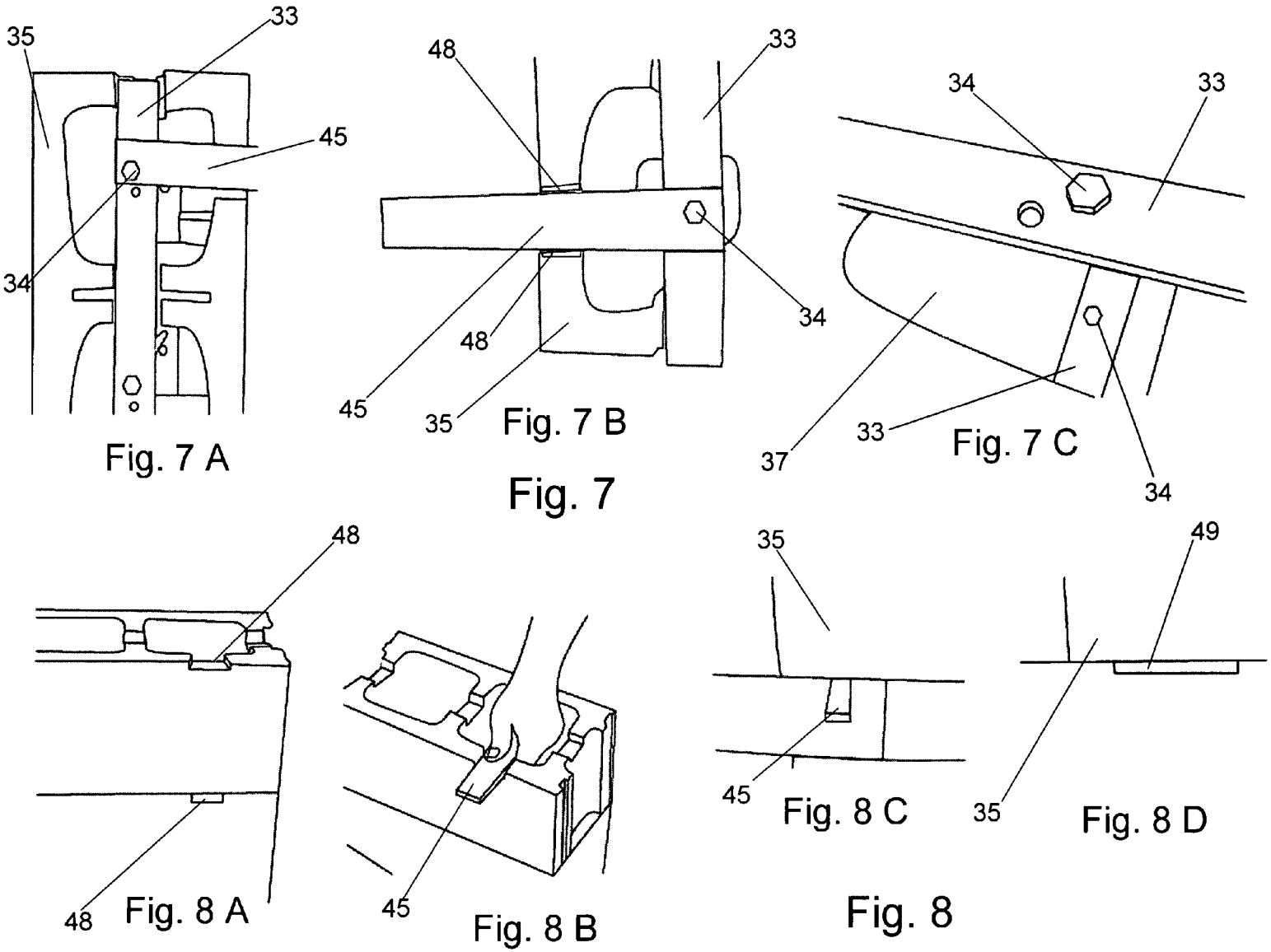
FIGS. 7 A through 7 C show the sketch details of the SPECIAL AND IMPROVED CONFIGURATIONS FOR UNITIZED POST TENSION BLOCK SYSTEM FOR MASONRY STRUCTURES with connector and expansion joints shown.
FIGS. 8 A through 8 D are sketches of the notches and fillers for the connector bars.

FIGS. 7 A through 7 C show the sketch details of the SPECIAL AND IMPROVED CONFIGURATIONS FOR UNITIZED POST TENSION BLOCK SYSTEM FOR MASONRY STRUCTURES 31 with connector bars 45 and expansion joints shown. Here the connector bar 45 is placed at right angles and joined in the through hole to other bars 33 by the bolt 34. This works well for "Tee" wall connections and for building piers and support columns for long walls. By using slotted apertures in the connector bar 45 and or normal anchors 33, an expansion connection may be created to provide thermal expansion if needed for some wall assemblies.

FIG. 8 A is a sketches of the notches 48 and fillers 49 for the connector bars 45. In FIG. 8 B, the connector bar 45 passes from the duct or cavity 37 of the CMU block 35 where it connects to an anchor bar 33 through the open notch 48. FIGS. 8 C and 8 D show the CMU block 35 with a filler 49 in the notch 48.

FIGS. 9 A and 9 B show sketches and sketches of roof truss clamping means 65, 65A. Here the top plate 60 is on top and contiguous to the uppermost block 35 in the system 31. The roof joists 61 are contiguous and rest on top of the top plates 60. The bands 65, 65A circumvent the joist 61 and the uppermost anchor bar 33. One skilled and well versed in mechanical and structural connections appreciate that the bands 65, 65A are "tightened" or shortened to increase the tension within the band 65, 65A to secure the joist 61 to the bar 33. Likewise, skilled persons appreciate that the bar 33 is interconnected to the rest of the steel network of bars 33 and bolts 34 by the immediate connection offered by the contiguous bolt 34 to the bar 33 as demonstrated in the sketches. The bolts 34 pass through the cavity 37 to the next bar 33 (not shown). The band 65 in FIG. 9 A anticipates a new use for a steel, composites, plastic metal, or the like, "radiator clamp"—like device. In the FIG. 9 B a long clamp device 65A shows the interconnect from the top plate 60 and joist 61 all the way to the wall sill plate 50. Here, the band 65A has an aperture 65B by which a tendon/screw 34A is connected through the aperture 65B to secure the band 65A to the sill plate 50. This special band 65A anticipates a material such as plastic or composite materials, but could conceivably be along metal or steel band 65.

FIGS. 10 A and 10 B provide sketches contrasting a typical masonry and mortar footer (FIG. 10 A) versus a SPECIAL AND IMPROVED CONFIGURATIONS FOR UNITIZED POST TENSION BLOCK SYSTEM FOR MASONRY STRUCTURES 31 (shown in FIG. 10 B). In FIG. 10 A, an original trough 70 is dug and a foundation footer 71 poured. Next, the block 35 are laid with the traditional mortar between each layer. The sill plate 50 is placed on top of the uppermost block 35. The wood structure then is placed including the floor joist 80 (on top of the sill plate 50); the band board 81 around the perimeter of the joists 80; the base plate 73 and wall studs 72; the sub flooring 77; and the interior wall sheeting 78. Contrasted to this is shown in FIG. 10 B. A footer trough 43 is dug and an amount of self leveling aggregate 32 is placed in the trough 43. Then a footer block 41, 41A is placed on the aggregate 32 and the block 35 are assembled in the SPECIAL AND IMPROVED CONFIGURATIONS FOR UNITIZED POST TENSION BLOCK SYSTEM FOR MASONRY STRUCTURES 31. A special "extra wide" ledge block 74 is placed as shown in the drawing. Another block or CMU 35 is placed on the extra wide ledger 74 which eliminates the necessity of a part of the joist 80 and the band board 81. The rest of the structure is very similar to traditional buildings with the sill plate 50 placed on top of the uppermost block 35. The wood structure then is placed including the floor joist 80 (on top of the sill plate 50); the base plate 73 and wall studs 72; the sub flooring 77; and the interior wall sheeting 78. One may note that the perimeter drain 79 is easily installed on top of the aggregate 32 and contiguous to the footer 41, 41A.

FIGS. 18 A and 18 B show sketches of beam applications for SPECIAL AND IMPROVED CONFIGURATIONS FOR UNITIZED POST TENSION BLOCK SYSTEM FOR MASONRY STRUCTURES 31. Here the CMU block 35 are connected as a series of soldier blocks, interconnected to form a beam 93 which rests on supports 92. This sketch demonstrates the significant span accomplished by the SPECIAL AND IMPROVED CONFIGURATIONS FOR UNITIZED POST TENSION BLOCK SYSTEM FOR MASONRY STRUCTURES 31.

The details mentioned here are exemplary and not limiting. Stated again and well appreciated by one skilled in the art of construction materials, all the examples of the connecting devices and apparatus (preferred materials shown as a rust-resisting steel or equal) may be substituted with other plastics and composite materials that have similar properties and still be within the scope and spirit of this SPECIAL AND IMPROVED CONFIGURATIONS FOR UNITIZED POST TENSION BLOCK SYSTEMS FOR MASONRY STRUCTURES 31. Other components specific to describing a SPE- CIAL AND IMPROVED CONFIGURATIONS FOR UNITIZED POST TENSION BLOCK SYSTEMS FOR MASONRY STRUCTURES 31 may be added as a person having ordinary skill in the field of construction as being obvious from the above described embodiment.

Operation of the Preferred Embodiment

The new SPECIAL AND IMPROVED CONFIGURATIONS FOR UNITIZED POST TENSION BLOCK SYSTEMS FOR MASONRY STRUCTURES 31 has been described in the above embodiment. The manner of how the improvement operates is described below. Note well that the description above and the operation described here must be taken together to fully illustrate the concept of the SPECIAL AND IMPROVED CONFIGURATIONS FOR UNITIZED POST TENSION BLOCK SYSTEMS FOR MASONRY STRUCTURES 31. In FIGS. 11 through 17 a complete and accurate representation of how the improve concept is shown and described.

Figure 11:
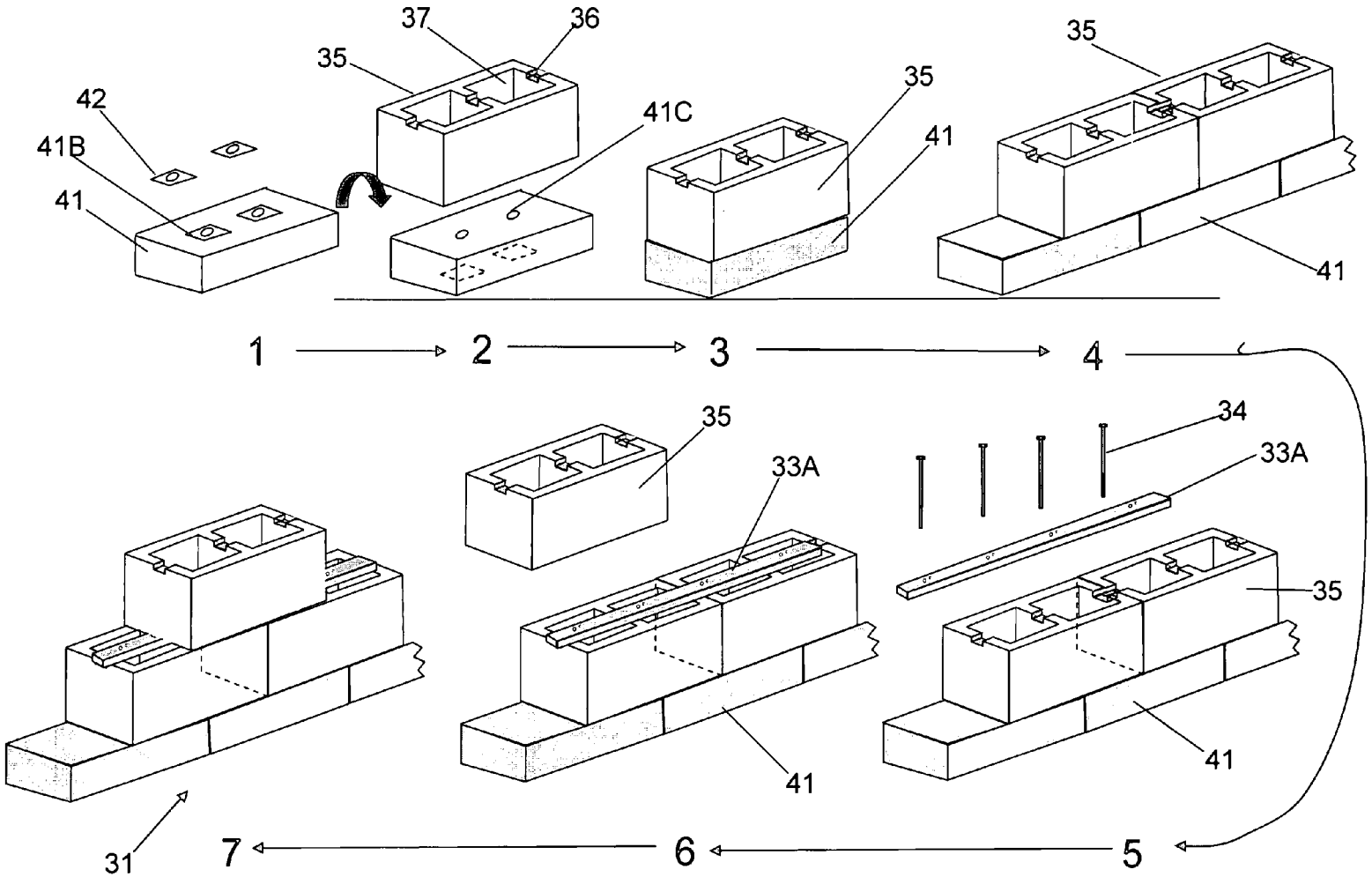
FIG. 11 shows the process of assembly for a SPECIAL AND IMPROVED CONFIGURATIONS FOR UNITIZED POST TENSION BLOCK SYSTEM FOR MASONRY STRUCTURES, including steps 1 through 7 for a CMU with recessed pockets.

FIG. 11 shows the process of assembly for a SPECIAL AND IMPROVED CONFIGURATIONS FOR UNITIZED POST TENSION BLOCK SYSTEM FOR MASONRY STRUCTURES 31, including steps 1 through 7 for a CMU with recessed pockets. The process shown is for a CMU with extended recessed channels 36 and linear footers 41, but the general flow is similar for all the different embodiments of the SPECIAL AND IMPROVED CONFIGURATIONS FOR UNITIZED POST TENSION BLOCK SYSTEM FOR MASONRY STRUCTURES 31. There are shown 7 steps shown in Table C that correspond to the steps shown in FIG. 11. These steps are then repeated as additional CMUs 35 are needed for the desired structure 31.

TABLE C

Assembly Process

| Step | Description |
|---|---|
| 1 | Place a linear footer 41 (upside down) and place bolt plate 42 into the recessed pockets 41B. |
| 2 | Flip footer 41 over and place CMU block 35 onto the top surface of the footer 41. |
| 3 | Align the sides of the CMU 35 with other CMUs 35 and the footer block 41. |
| 4 | Place additional CMUs 35 and footers 41 and align the system components with each other. |
| 5 | Place anchor bars 33A and then tendon/through bolts 34 into the through apertures in the uppermost anchor/bars 33. |
| 6 | Tighten the tendon/through bolts 34 into the threaded apertures in the lowermost starter anchor/bars 33 by means of a wrench or equal. |
| 7 | Place additional CMUs 35 on the assembly 31 and repeat the placement of bars 33 and bolts 34. Repeat process until structure is completed. |

FIGS. 12 A and 12 B show are sketches of the method to use and operate the general stone leveling float devices 38 with the SPECIAL AND IMPROVED CONFIGURATIONS FOR UNITIZED POST TENSION BLOCK SYSTEM FOR MASONRY STRUCTURES 31.

In FIG. 12 A, the operator 40 places the laser signal generator 39 in the corner of the footer trough 43. He places this on the master or keystone footer 41. All other block in the foundation will depend on and "take" reference to the prime signal generator 39 from this initial setting. FIG. 12 B shows the operator 40 beginning to level the stone 32 in the footer trough 43 with the General Sled leveler 38 sensing the beam from the laser signal generator 39. The sketches/graph shows the operator 40 using the level 38 with the signal receiver 39A leveling the stone 32.

FIGS. 13 A to 13 C are further steps in installing the SPECIAL AND IMPROVED CONFIGURATIONS FOR UNITIZED POST TENSION BLOCK SYSTEM FOR MASONRY STRUCTURES 31 after the level 38 has leveled the stone aggregate base 32. FIG. 13 A shows the operator 40 placing a threaded bolt plate 42 into a pocket or recess 41B. One sees the similarity and differences of a linear footer 41 with one pocket 42 and a cross footer 41A with two pockets 42. In FIG. 13 B the operator 40 places a linear footer 41 on the stone 32 in the footer trough 43. One may note the through hole (aperture) 41C where the tendon or bolt 34 will pass through to engage the threads in the threaded plate 42. In FIG. 13 C, the operator continues with another linear footer 41 perpendicular to the first footer 41 and then the initial foundation block 35.

FIGS. 14 A through 14 D show additional usage and operative details of the SPECIAL AND IMPROVED CONFIGURATIONS FOR UNITIZED POST TENSION BLOCK SYSTEM FOR MASONRY STRUCTURES 31. In these four (4) sketches/graphs, the operator begins to add foundation blocks 35 onto the footers 41. The bar or anchor 33 of the SPECIAL AND IMPROVED CONFIGURATIONS FOR UNITIZED POST TENSION BLOCK SYSTEM FOR MASONRY STRUCTURES 31 is placed in the recess 36 of the block 35 and assembles the block to the footer 41. One skilled in block making and using may note well that corner blocks 35 may have the recess 36 closed over at the exterior to form a finished surface 36 A. The secure assembly process is accomplished when a bolt or tendon 34 connects to the plate 42 and fully secures the foundation block 35 to the footer block 41, below. A pneumatic or electric drive tool 51 is used to turn the bolts 34. In FIG. 14 C, a couple of cross footers 41A are placed for additional strength and stability if needed or desired.

FIGS. 15 A through E show sketches and graphs of additional steps in the process of assembly for a SPECIAL AND IMPROVED CONFIGURATIONS FOR UNITIZED POST TENSION BLOCK SYSTEM FOR MASONRY STRUCTURES 31. The significant features shown here are in respect to placing extended bars 33A across several block 35 at a time. Then multiple tendons or bolts 34 may be rapidly placed and started with the operator 40 then using the driver 51 to complete the tensioning process by driving the bolts flush against the anchor bars 33, 33A. The sketches depict the operation from several viewpoints for complete illustration of the process for assembling a SPECIAL AND IMPROVED CONFIGURATIONS FOR UNITIZED POST TENSION BLOCK SYSTEM FOR MASONRY STRUCTURES 31.

FIGS. 16 A and 16 D show sketches and graphs of the leveled stone base 32 resulting in level and plumb wall systems for the SPECIAL AND IMPROVED CONFIGURATIONS FOR UNITIZED POST TENSION BLOCK SYSTEM FOR MASONRY STRUCTURES 31. The foundation blocks 35 and footers 41, 41A are continued. The bars or anchors 34 are placed onto the block 35. FIG. 16 B shows a nearly complete wall section with the sill plate 50 in place. In FIGS. 16 C and 16 D the accuracy of the building system on this type of leveled foundation of stone 32 is monitored by a carpenter's level in a horizontal 46 and vertical 46A position. The bubble indicator for level 52 is shown in FIG. 16 C and the plumb indicator 52A in FIG. 16 D. Both indicate a very accurate result with the use of the General Sled leveler 38 and the SPECIAL AND IMPROVED CONFIGURATIONS FOR UNITIZED POST TENSION BLOCK SYSTEM FOR MASONRY STRUCTURES 31.

FIGS. 17 A through D show finishing steps for the process of assembling and completing the SPECIAL AND IMPROVED CONFIGURATIONS FOR UNITIZED POST TENSION BLOCK SYSTEM FOR MASONRY STRUCTURES 31. In FIG. 17 A the SPECIAL AND IMPROVED CONFIGURATIONS FOR UNITIZED POST TENSION BLOCK SYSTEM FOR MASONRY STRUCTURES 31 comprised of blocks 35 has an insulation board 58 applied as is common to the building industry, Such boards or panels 58 may be placed interiorly or exteriorly onto the wall surface. FIG. 17 B shows the wall being sprayed with a sealant 59. Alternatively it could be sealed with paints, epoxies, bituminous coatings or cementitious coatings sprayed or troweled onto the surface. Further alternatives include stuccos and other surface finishes. FIG. 17 C shows the sill plate 50 being installed. In FIG. 17 D the wall systems 31 show the extended bars 33A. The time indicator 66 shows the rapid completion of the wall and immediately useable to start the rest of the building without waiting for the mortar to set and cure.

With this description of the detailed parts and operation it is to be understood that the SPECIAL AND IMPROVED CONFIGURATIONS FOR UNITIZED POST TENSION BLOCK SYSTEMS FOR MASONRY STRUCTURES 31 is not to be limited to the disclosed embodiment. The features of the SPECIAL AND IMPROVED CONFIGURATIONS FOR UNITIZED POST TENSION BLOCK SYSTEM FOR MASONRY STRUCTURES 31 are intended to cover various modifications and equivalent arrangements included within the spirit and scope of the description.

What is claimed is:

1. A system for building a masonry structure with unitized post tensioning reinforcement, the system comprising:

a masonry unit, the masonry unit being made of concrete and comprising:

a masonry longitudinal length, a masonry width measured perpendicularly to the masonry longitudinal length, wherein the masonry width is substantially uniform along the masonry longitudinal length, a masonry top surface, the masonry top surface being substantially planar, a masonry bottom surface, the masonry bottom surface being substantially planar, a masonry height measured between the masonry top and masonry bottom surfaces, the masonry height being substantially uniform along the masonry longitudinal length, a first masonry through-cavity and a second masonry through-cavity formed through the masonry unit from the masonry top surface to the masonry bottom surface, and a masonry longitudinal recess formed in the masonry top surface and oriented substantially along the masonry longitudinal length;

a footer block, the footer block being made of concrete and comprising:

a footer longitudinal length substantially the same as the masonry longitudinal length;

a footer width measured perpendicularly to the footer longitudinal length, wherein the footer width is substantially uniform along the footer longitudinal length, a footer top surface, the footer top surface being substantially planar, a footer bottom surface, the footer bottom surface being substantially planar, a footer height measured between the footer top and footer bottom surfaces, the footer height being substantially uniform along the footer longitudinal length, a footer recess formed on the footer bottom surface, and a footer through-hole formed from the footer top surface to the footer recess;

an anchor bar, the anchor bar comprising:

a first set of apertures, the first set of apertures comprising a first non-threaded aperture and a first threaded aperture, a second set of apertures, the second set of apertures comprising a second non-threaded aperture that is substantially the same as the first non-threaded aperture, and a second threaded aperture that is substantially the same as the first threaded aperture, wherein the anchor bar fits into the masonry longitudinal recess such that, when received by the masonry longitudinal recess, the anchor bar does not protrude above the masonry top surface, a fastener, the fastener comprising:

a first fastener end and a second fastener end, a head portion at the first fastener end, a stem portion rigidly affixed to the head portion, the stem portion comprising a threaded portion at the second fastener end, wherein an overall length of the stem portion is greater than a sum of the masonry height and the footer height, wherein the head portion does not fit through the first non-threaded aperture, wherein the stem portion slides freely through the first non-threaded aperture, wherein the threaded portion is configured to threadably engage the first threaded aperture, and wherein the fastener is able to slide freely through the footer through-hole;

a footer plate, the footer plate comprising:

a footer threaded aperture, the footer threaded aperture configured to threadably engage the threaded portion of the fastener, wherein the footer plate fits within the footer recess such that, when received by the footer recess, the footer plate does not protrude below the second bottom surface and the footer plate is substantially prevented from rotating within the footer recess.

2. The system of claim 1, wherein a horizontal area of the footer recess is smaller than a horizontal area of the first masonry through-cavity.

3. The system of claim 2, wherein a horizontal area of the footer through-hole is smaller than the horizontal area of the footer recess.

4. The system of claim 1, wherein the footer height is less than the masonry height.

5. The system of claim 4, wherein the footer height is half of the masonry height.

6. The system of claim 1, wherein the footer block is a first footer block, wherein the fastener is a first fastener, and wherein the footer plate is a first footer plate, the system further comprising:

a second footer block substantially the same as the first footer block;

a second fastener substantially the same as the first fastener; and a second footer plate substantially the same as the first footer plate, wherein the anchor bar is in the masonry longitudinal recess, wherein the first fastener extends through the first non-threaded aperture, through the first masonry through-cavity, through the footer through-hole of the first footer block, and into threadable engagement with the footer threaded aperture of the first footer plate in the footer recess of the first footer block, and wherein the second fastener extends through the second non-threaded aperture, through the second masonry through-cavity, through the footer through-hole of the second footer block, and into threadable engagement with the footer threaded aperture of the second footer plate in the footer recess of the second footer block.

7. The system of claim 6, wherein the masonry unit is a first masonry unit, wherein the footer recess of the second footer block is a first footer recess, and wherein the footer through-hole of the second footer block is a first footer through-hole, wherein the second footer block further comprises a second footer recess formed on the footer bottom surface and a second footer through-hole formed from the footer top surface to the second footer recess, the system further comprising:

a second masonry unit substantially the same as the first masonry unit;

a third fastener substantially the same as the first fastener; and a third footer plate substantially the same as the first footer plate, wherein the first footer block is adjacent to the second footer block, the first masonry unit is adjacent to and on top of the first footer block and the second footer block, and the second masonry unit is adjacent to the first masonry unit and on top of the second footer block, wherein the anchor bar comprises a third set of apertures, the third set of apertures comprising a third non-threaded aperture that is substantially the same as the first non-threaded aperture, and a third threaded aperture that is substantially the same as the first threaded aperture, wherein the anchor bar is received by and spans the masonry longitudinal recess of the first masonry unit and the masonry longitudinal recess of the second masonry unit, and wherein the third fastener extends through the third non-threaded aperture, through the first masonry through-cavity of the second masonry unit, through the second footer through-hole of the second footer block, and into threadable engagement with the footer threaded aperture of the third footer plate in the second footer recess of the second footer block.

8. The system of claim 1, wherein the footer through-hole has a substantially circular cross-sectional shape.

9. The system of claim 6, wherein the masonry unit is a first masonry unit, wherein the anchor bar is a first anchor bar, wherein the footer recess of the second footer block is a first footer recess, and wherein the footer through-hole of the second footer block is a first footer through-hole, wherein the second footer block further comprises a second footer recess formed on the footer bottom surface and a second footer through-hole formed from the footer top surface to the second footer recess, the system further comprising:

a second masonry unit substantially the same as the first masonry unit;

a second anchor bar substantially the same as the first anchor bar, wherein each of the first anchor bar and second anchor bar have a length substantially the same as the masonry longitudinal length;

a third fastener substantially the same as the first fastener; and a third footer plate substantially the same as the first footer plate, wherein the first footer block is adjacent to the second footer block, the first masonry unit is adjacent to and on top of the first footer block and the second footer block, and the second masonry unit is adjacent to the first masonry unit and on top of the second footer block, wherein the first anchor bar is received by the masonry longitudinal recess of the first masonry unit, wherein the second anchor bar is received by the masonry longitudinal recess of the second masonry unit, and wherein the third fastener extends through the first non-threaded aperture of the second anchor bar, through the first masonry through-cavity of the second masonry unit, through the second footer through-hole of the second footer block, and into threadable engagement with the footer threaded aperture of the third footer plate in the second footer recess of the second footer block.

10. The system of claim 1, wherein the footer plate has a substantially rectangular horizontal cross sectional shape.

11. A system for building a masonry structure with unitized post tensioning reinforcement, the system comprising:

a masonry unit comprising:

a masonry longitudinal length, a masonry width measured perpendicularly to the masonry longitudinal length, wherein the masonry width is substantially uniform along the masonry longitudinal length, a masonry top surface, the masonry top surface being substantially planar, a masonry bottom surface, the masonry bottom surface being substantially planar, a masonry height measured between the masonry top and masonry bottom surfaces, the masonry height being substantially uniform along the masonry longitudinal length, a first masonry through-cavity and a second masonry through-cavity formed through the masonry unit from the masonry top surface to the masonry bottom surface, and a masonry longitudinal recess formed in the masonry top surface and oriented substantially along the masonry longitudinal length;

a footer block comprising:

a footer longitudinal length substantially the same as the masonry longitudinal length;

a footer width measured perpendicularly to the footer longitudinal length, wherein the footer width is substantially uniform along the footer longitudinal length, a footer top surface, the footer top surface being substantially planar, a footer bottom surface, the footer bottom surface being substantially planar, a footer height measured between the footer top and footer bottom surfaces, the footer height being substantially uniform along the footer longitudinal length, a footer recess formed on the footer bottom surface, and a footer through-hole formed from the footer top surface to the footer recess;

an anchor bar, the anchor bar comprising:

a first set of apertures, the first set of apertures comprising a first non-threaded aperture and a first threaded aperture, a second set of apertures, the second set of apertures comprising a second non-threaded aperture that is substantially the same as the first non-threaded aperture, and a second threaded aperture that is substantially the same as the first threaded aperture, wherein the anchor bar fits into the masonry longitudinal recess such that, when received by the masonry longitudinal recess, the anchor bar does not protrude above the masonry top surface, a fastener, the fastener comprising:

a first fastener end and a second fastener end, a head portion at the first fastener end, a stem portion rigidly affixed to the head portion, the stem portion comprising a threaded portion at the second fastener end, wherein an overall length of the stem portion is greater than a sum of the masonry height and the footer height, wherein the head portion does not fit through the first non-threaded aperture, wherein the stem portion slides freely through the first non-threaded aperture, wherein the threaded portion is configured to threadably engage the first threaded aperture, and wherein the fastener is able to slide freely through the footer through-hole;

a footer plate, the footer plate comprising:

a footer threaded aperture, the footer threaded aperture configured to threadably engage the threaded portion of the fastener, wherein the footer plate fits within the footer recess such that, when received by the footer recess, the footer plate is substantially prevented from turning horizontally within the footer recess.

12. The system of claim 1, wherein a horizontal area of the footer recess is smaller than a horizontal area of the first masonry through-cavity.

13. The system of claim 2, wherein a horizontal area of the footer through-hole is smaller than the horizontal area of the footer recess.

14. The system of claim 1, wherein the footer height is less than the masonry height.

15. The system of claim 4, wherein the footer height is half of the masonry height.

16. The system of claim 1, wherein the footer block is a first footer block, wherein the fastener is a first fastener, and wherein the footer plate is a first footer plate, the system further comprising:

a second footer block substantially the same as the first footer block;

a second fastener substantially the same as the first fastener; and a second footer plate substantially the same as the first footer plate, wherein the anchor bar is in the masonry longitudinal recess, wherein the first fastener extends through the first non-threaded aperture, through the first masonry through-cavity, through the footer through-hole of the first footer block, and into threadable engagement with the footer threaded aperture of the first footer plate in the footer recess of the first footer block, and wherein the second fastener extends through the second non-threaded aperture, through the second masonry through-cavity, through the footer through-hole of the second footer block, and into threadable engagement with the footer threaded aperture of the second footer plate in the footer recess of the second footer block.

17. The system of claim 6, wherein the masonry unit is a first masonry unit, wherein the footer recess of the second footer block is a first footer recess, and wherein the footer through-hole of the second footer block is a first footer through-hole, wherein the second footer block further comprises a second footer recess formed on the footer bottom surface and a second footer through-hole formed from the footer top surface to the second footer recess, the system further comprising:

a second masonry unit substantially the same as the first masonry unit;

a third fastener substantially the same as the first fastener; and a third footer plate substantially the same as the first footer plate, wherein the first footer block is adjacent to the second footer block, the first masonry unit is adjacent to and on top of the first footer block and the second footer block, and the second masonry unit is adjacent to the first masonry unit and on top of the second footer block, wherein the anchor bar comprises a third set of apertures, the third set of apertures comprising a third non-threaded aperture that is substantially the same as the first non-threaded aperture, and a third threaded aperture that is substantially the same as the first threaded aperture, wherein the anchor bar is received by and spans the masonry longitudinal recess of the first masonry unit and the masonry longitudinal recess of the second masonry unit, and wherein the third fastener extends through the third non-threaded aperture, through the first masonry through-cavity of the second masonry unit, through the second footer through-hole of the second footer block, and into threadable engagement with the footer threaded aperture of the third footer plate in the second footer recess of the second footer block.

18. The system of claim 1, wherein the footer through-hole has a substantially circular cross-sectional shape.

19. The system of claim 6, wherein the masonry unit is a first masonry unit, wherein the anchor bar is a first anchor bar, wherein the footer recess of the second footer block is a first footer recess, and wherein the footer through-hole of the second footer block is a first footer through-hole, wherein the second footer block further comprises a second footer recess formed on the footer bottom surface and a second footer through-hole formed from the footer top surface to the second footer recess, the system further comprising:

a second masonry unit substantially the same as the first masonry unit;

a second anchor bar substantially the same as the first anchor bar, wherein each of the first anchor bar and second anchor bar have a length substantially the same as the masonry longitudinal length;

a third fastener substantially the same as the first fastener; and a third footer plate substantially the same as the first footer plate, wherein the first footer block is adjacent to the second footer block, the first masonry unit is adjacent to and on top of the first footer block and the second footer block, and the second masonry unit is adjacent to the first masonry unit and on top of the second footer block, wherein the first anchor bar is received by the masonry longitudinal recess of the first masonry unit, wherein the second anchor bar is received by the masonry longitudinal recess of the second masonry unit, and wherein the third fastener extends through the first non-threaded aperture of the second anchor bar, through the first masonry through-cavity of the second masonry unit, through the second footer through-hole of the second footer block, and into threadable engagement with the footer threaded aperture of the third footer plate in the second footer recess of the second footer block.

20. The system of claim 1, wherein the footer plate has a substantially rectangular horizontal cross sectional shape.

* * * * *